US012687373B2

(12) United States Patent
Faifer

(10) Patent No.: US 12,687,373 B2
(45) Date of Patent: Jul. 21, 2026

(54) STOCK FOR A SMALL ARMS WEAPON, RECOIL REDUCTION SYSTEM, AND METHOD

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 0 days.

(21) Appl. No.: 18/457,292

(22) Filed: Aug. 28, 2023

(65) Prior Publication Data

US 2024/0077279 A1 Mar. 7, 2024

Related U.S. Application Data

(63) Continuation-in-part of application No. 29/866,097, filed on Aug. 28, 2022, now Pat. No. Des. 1,053,300.

(60) Provisional application No. 63/373,728, filed on Aug. 28, 2022.

(51) Int. Cl.
*F41C 23/06* (2006.01)

(52) U.S. Cl.
CPC ..... *F41C 23/06* (2013.01)

(58) Field of Classification Search
CPC ..... F41C 23/06
See application file for complete search history.

(56) References Cited

U.S. PATENT DOCUMENTS 294,402 A 3/1884 Onderdonk
319,613 A 6/1885 Onderdonk
436,997 A 9/1890 Quackenbush
746,859 A 12/1903 Marble
922,173 A 5/1909 Lovelace
931,328 A 8/1909 Marble
961,511 A 6/1910 Marble
1,051,960 A 2/1913 Kennedy
1,086,490 A 2/1914 Weathers
1,156,293 A 10/1915 Jorgenson
1,174,840 A 3/1916 Fisher
1,315,215 A 9/1919 Davidson
1,485,456 A 3/1924 Von Frommer
1,526,847 A 2/1925 Fritz
1,734,852 A 11/1929 Frampton et al.
1,822,875 A 9/1931 Ammann
2,098,139 A 11/1937 Foley et al.
2,400,422 A 5/1946 Johnson, Jr.
2,424,194 A 7/1947 Sampson et al.
2,433,151 A 12/1947 Parsons
2,766,542 A 10/1956 Harvey
3,044,204 A 7/1962 Zimmerman
3,348,328 A 10/1967 Roy
(Continued)

*Primary Examiner* — J. Woodrow Eldred
(74) *Attorney, Agent, or Firm* — Law Office of Arthur M. Antonelli, PLLC

(57) ABSTRACT

A stock (28) for a small arms weapon is disclosed. The stock may include a recoil reduction system (40). The recoil reduction system (4) may include a drive assembly (46) and a recoil force storage apparatus (48). The drive assembly (46) may include a latch bolt (44), a pin carrier (50) and a drive link (52). The recoil force storage apparatus may include a rocker (or lever arm) (54) and a recoil force storage device (56). The recoil force storage device may include a strut assembly (222). The strut assembly may include a coil spring (228). The recoil force reduction system may include three selectable operational modes. Each operational mode may provide a different level of recoil reduction (e.g., high, medium, and low).

17 Claims, 23 Drawing Sheets

(56) References Cited

U.S. PATENT DOCUMENTS

| | | | |
|---|---|---|---|
| 3,618,248 | A | 11/1971 | Into et al. |
| 3,618,249 | A | 11/1971 | Grandy |
| 4,115,943 | A | 9/1978 | Musgrave |
| 4,141,166 | A | 2/1979 | Schultz |
| 4,271,623 | A | 6/1981 | Beretta |
| 4,327,626 | A | 5/1982 | McQueen |
| 4,383,384 | A | 5/1983 | Fox |
| 4,512,101 | A | 4/1985 | Waterman, Jr. |
| 4,551,937 | A | 11/1985 | Seehase |
| 4,697,367 | A | 10/1987 | Brophy |
| 4,735,007 | A | 4/1988 | Gal |
| 4,788,785 | A | 12/1988 | White |
| D324,557 | S | 3/1992 | Livingston |
| 5,209,215 | A | 5/1993 | Morrison |
| 5,225,613 | A | 7/1993 | Claridge |
| 5,622,000 | A | 4/1997 | Marlowe |
| 5,711,102 | A | 1/1998 | Plaster et al. |
| D391,334 | S | 2/1998 | Plaster et al. |
| 5,907,918 | A | 6/1999 | Langevin et al. |
| 6,250,194 | B1 | 6/2001 | Brandl et al. |
| 6,560,911 | B2 | 5/2003 | Sharp |
| 6,598,329 | B1 | 7/2003 | Alexander |
| 6,598,330 | B2 | 7/2003 | Garrett et al. |
| 6,637,141 | B1 | 10/2003 | Weatherby et al. |
| 6,651,371 | B2 | 11/2003 | Fitzpatrick et al. |
| 6,779,289 | B2 | 8/2004 | Kay |
| 6,829,855 | B2 | 12/2004 | Seifert |
| 6,839,998 | B1 | 1/2005 | Armstrong |
| 6,874,267 | B2 | 4/2005 | Fitzpatrick et al. |
| 6,925,743 | B1 | 8/2005 | DiGiovanna |
| D517,637 | S | 3/2006 | Murello et al. |
| 7,104,001 | B1 | 9/2006 | Digiovanna |
| 7,131,228 | B2 | 11/2006 | Hochstrate et al. |
| 7,152,355 | B2 | 12/2006 | Fitzpatrick et al. |
| 7,162,822 | B1 | 1/2007 | Heayn et al. |
| 7,162,823 | B2 | 1/2007 | Schoppman et al. |
| 7,337,573 | B1 | 3/2008 | Digiovanna |
| 7,398,616 | B1 | 7/2008 | Weir |
| 7,418,797 | B1 | 9/2008 | Crose |
| 7,428,794 | B2 | 9/2008 | Oz |
| D584,373 | S | 1/2009 | Young |
| D589,578 | S | 3/2009 | Choma |
| D600,304 | S | 9/2009 | Fitzpatrick et al. |
| D600,305 | S | 9/2009 | Fitzpatrick et al. |
| D600,306 | S | 9/2009 | Fitzpatrick et al. |
| D600,307 | S | 9/2009 | Fitzpatrick et al. |
| D600,308 | S | 9/2009 | Fitzpatrick et al. |
| 7,587,852 | B1 | 9/2009 | Harms |
| D602,555 | S | 10/2009 | Fitzpatrick et al. |
| D603,013 | S | 10/2009 | Fitzpatrick et al. |
| D604,793 | S | 11/2009 | Fitzpatrick et al. |
| D604,794 | S | 11/2009 | Bentley |
| 7,610,711 | B2 | 11/2009 | Oz |
| D606,614 | S | 12/2009 | Fitzpatrick et al. |
| D607,078 | S | 12/2009 | Chu |
| 7,627,975 | B1 | 12/2009 | Hines |
| 7,640,688 | B2 | 1/2010 | Oz |
| 7,647,719 | B2 | 1/2010 | Fitzpatrick et al. |
| 7,654,187 | B2 | 2/2010 | Hochstrate et al. |
| 7,681,351 | B2 | 3/2010 | Bucholtz et al. |
| D616,056 | S | 5/2010 | Bentley |
| 7,743,544 | B2 | 6/2010 | Laney et al. |
| D620,067 | S | 7/2010 | Saur |
| 7,762,018 | B1 | 7/2010 | Fitzpatrick et al. |
| D622,802 | S | 8/2010 | Fitzpatrick et al. |
| 7,775,150 | B2 | 8/2010 | Hochstrate et al. |
| 7,805,873 | B2 | 10/2010 | Bentley |
| 7,810,270 | B2 | 10/2010 | Fitzpatrick et al. |
| 7,823,313 | B2 | 11/2010 | Faifer |
| 7,827,722 | B1 | 11/2010 | Davies |
| 7,849,626 | B2 | 12/2010 | Fluhr |
| D631,122 | S | 1/2011 | Domagtoy |
| D634,388 | S | 3/2011 | Peterson et al. |
| D636,833 | S | 4/2011 | Mayberry et al. |
| D636,834 | S | 4/2011 | Mayberry et al. |
| 7,930,849 | B2 | 4/2011 | Abraham et al. |
| 7,937,873 | B2 | 5/2011 | Keng |
| D640,342 | S | 6/2011 | Fitpatrick et al. |
| 7,966,760 | B2 | 6/2011 | Fitzpatrick et al. |
| 7,992,336 | B2 | 8/2011 | Phillips |
| 8,006,425 | B2 | 8/2011 | Burt et al. |
| D645,533 | S | 9/2011 | Petersom et al. |
| 8,061,072 | B1 | 11/2011 | Crose |
| 8,127,483 | B2 | 3/2012 | Kincel |
| 8,127,485 | B2 | 3/2012 | Kincel |
| D661,366 | S | 6/2012 | Zusman |
| 8,191,299 | B2 | 6/2012 | Faifer |
| D668,311 | S | 10/2012 | Rogers et al. |
| 8,327,568 | B1 | 12/2012 | Lavergne et al. |
| 8,341,868 | B2 | 1/2013 | Zusman |
| D676,921 | S | 2/2013 | Fitzpatrick et al. |
| 8,387,298 | B2 | 3/2013 | Kincel |
| D683,808 | S | 6/2013 | Elkaim |
| D688,768 | S | 8/2013 | Fitzpatrick et al. |
| D691,234 | S | 10/2013 | Fitzpatrick et al. |
| D692,087 | S | 10/2013 | Fitzpatrick et al. |
| 8,555,541 | B2 | 10/2013 | Ingram |
| D695,377 | S | 12/2013 | Mayberry et al. |
| D697,162 | S | 1/2014 | Faifer |
| D700,265 | S | 2/2014 | Mayberry et al. |
| 8,707,603 | B2 | 4/2014 | Troy et al. |
| D704,294 | S | 5/2014 | Jarboe |
| 8,756,849 | B2 | 6/2014 | Troy |
| 8,800,189 | B2 | 8/2014 | Fitzpatrick et al. |
| 8,813,157 | B2 | 8/2014 | Le Leannec et al. |
| D712,998 | S | 9/2014 | Gomez |
| 8,844,185 | B2 | 9/2014 | Jarboe |
| D716,403 | S | 10/2014 | Burt et al. |
| 8,943,728 | B2 | 2/2015 | Ward et al. |
| D725,219 | S | 3/2015 | Hirt et al. |
| 8,978,284 | B1 | 3/2015 | Zusman |
| 9,052,155 | B2 | 6/2015 | Fluhr et al. |
| D736,336 | S | 8/2015 | Mayberry et al. |
| 9,109,856 | B1 | 8/2015 | Zamlinsky |
| D738,981 | S | 9/2015 | Zusman |
| D745,627 | S | 12/2015 | Kielsmeier et al. |
| D748,216 | S | 1/2016 | Zusman |
| 9,228,795 | B1 | 1/2016 | Kielsmeier et al. |
| 9,239,203 | B2 | 1/2016 | Jarboe et al. |
| D753,782 | S | 4/2016 | Vazquez et al. |
| 9,322,611 | B1 | 4/2016 | Barfoot et al. |
| D755,323 | S | 5/2016 | Eitan et al. |
| D755,331 | S | 5/2016 | Eitan et al. |
| D757,883 | S | 5/2016 | Chow et al. |
| D757,885 | S | 5/2016 | Barfoot et al. |
| D764,622 | S | 8/2016 | Bosco et al. |
| 9,404,708 | B1 | 8/2016 | Chow et al. |
| 9,410,764 | B2 | 8/2016 | Jarboe |
| 9,429,387 | B1 | 8/2016 | Barfoot et al. |
| D769,396 | S | 10/2016 | Keller, II |
| 9,464,863 | B2 | 10/2016 | Mather et al. |
| 9,488,433 | B2 | 11/2016 | Greenwood |
| 9,488,434 | B2 | 11/2016 | Kielsmeier et al. |
| 9,488,435 | B1 | 11/2016 | Roberts et al. |
| D773,592 | S | 12/2016 | Jones |
| D773,593 | S | 12/2016 | Hopkins et al. |
| 9,541,347 | B2 | 1/2017 | Maugham |
| 9,551,549 | B1 | 1/2017 | Chvala |
| D779,018 | S | 2/2017 | Zayatz et al. |
| D780,279 | S | 2/2017 | Bosco et al. |
| 9,581,411 | B2 | 2/2017 | Zusman |
| D781,392 | S | 3/2017 | Zayatz et al. |
| D785,122 | S | 4/2017 | Mather et al. |
| 9,612,084 | B2 | 4/2017 | Barfoot et al. |
| 9,664,476 | B1 | 5/2017 | Robinson et al. |
| 9,664,479 | B1 | 5/2017 | Robinson et al. |
| D792,936 | S | 7/2017 | Eitan et al. |
| D792,937 | S | 7/2017 | Eitan et al. |
| D795,981 | S | 8/2017 | Martelli et al. |
| D795,982 | S | 8/2017 | Ottosen |
| D795,985 | S | 8/2017 | Frederickson et al. |
| 9,739,565 | B2 | 8/2017 | Kielsmeier et al. |
| 9,746,281 | B2 | 8/2017 | Wilson et al. |
| D796,617 | S | 9/2017 | Chow et al. |

(56) References Cited

U.S. PATENT DOCUMENTS

D798,984 S 10/2017 Roberts et al.
9,784,526 B2 10/2017 Chow et al.
D804,602 S 12/2017 Barfoot et al.
D809,621 S 2/2018 Lam et al.
D810,225 S 2/2018 Huang et al.
D814,597 S 4/2018 Thornton
D818,074 S 5/2018 Ding et al.
D819,765 S 6/2018 Kafka et al.
9,995,553 B1 * 6/2018 Oglesby ..... F41A 3/80
10,036,602 B1 7/2018 Nuss et al.
10,060,699 B1 8/2018 Hu
D828,476 S 9/2018 Smith et al.
D831,149 S 10/2018 Barfoot et al.
10,215,526 B2 2/2019 Shinkle et al.
D847,933 S 5/2019 Windfeldt
10,386,138 B2 8/2019 Nuss et al.
D865,898 S 11/2019 Windfeldt
D868,924 S 12/2019 Nuss et al.
D871,536 S 12/2019 Lessard et al.
D883,419 S 5/2020 Windfeldt
10,760,875 B2 9/2020 Zhang
D899,549 S 10/2020 Hu
11,624,583 B2 4/2023 Faifer
D993,349 S 7/2023 Aguilar et al.
11,913,739 B2 2/2024 Nieh et al.
12,111,134 B2 10/2024 Moretti
12,117,257 B1 10/2024 Vanaken
D1,053,300 S 12/2024 Faifer
2003/0101631 A1 6/2003 Fitzpatrick et al.
2003/0110675 A1 6/2003 Garrett et al.
2003/0196366 A1 10/2003 Beretta
2003/0200693 A1 10/2003 Seifert
2004/0016167 A1 1/2004 Fitzpatrick et al.
2004/0055200 A1 3/2004 Fitzpatrick et al.
2004/0211104 A1 10/2004 Eberle
2004/0255505 A1 12/2004 Fitzpatrick
2005/0108915 A1 5/2005 Kincel
2005/0235546 A1 10/2005 Wonisch et al.
2005/0262752 A1 12/2005 Robinson et al.
2006/0096146 A1 5/2006 Fitzpatrick et al.
2006/0254414 A1 11/2006 Kuczynko et al.
2007/0261284 A1 11/2007 Keng
2008/0028662 A1 2/2008 Abraham et al.
2008/0236016 A1 10/2008 Fitzpatrick et al.
2008/0236017 A1 10/2008 Fitzpatrick et al.
2008/0301994 A1 12/2008 Langevin et al.
2009/0139128 A1 6/2009 Fluhr
2009/0178325 A1 7/2009 Veilleux
2009/0241397 A1 10/2009 Fitzpatrick et al.
2009/0255161 A1 10/2009 Fitzpatrick et al.
2009/0277066 A1 11/2009 Burt et al.
2010/0115817 A1 5/2010 Faifer
2010/0180485 A1 7/2010 Cabahug et al.
2010/0192444 A1 8/2010 Cabahug et al.
2010/0192446 A1 8/2010 Darian
2010/0192447 A1 8/2010 Cabahug et al.
2010/0205846 A1 8/2010 Fitzpatrick et al.
2010/0229444 A1 9/2010 Faifer
2010/0251591 A1 10/2010 Burt et al.
2010/0275482 A1 * 11/2010 Bentley ..... F41C 23/06
42/1.06
2010/0275489 A1 11/2010 Cabahug et al.
2010/0300277 A1 12/2010 Hochstrate et al.
2011/0099872 A1 5/2011 Bentley
2011/0173863 A1 7/2011 Ingram
2011/0192067 A1 8/2011 Troy
2011/0258899 A1 10/2011 Fitzpatrick et al.
2012/0000108 A1 1/2012 Zusman
2012/0042556 A1 2/2012 Vesligaj
2012/0079752 A1 4/2012 Peterson et al.
2012/0131829 A1 5/2012 Fistikchi
2012/0174455 A1 7/2012 Edelman et al.
2012/0174456 A1 7/2012 DePierro et al.
2012/0174457 A1 7/2012 Edelman
2012/0180353 A1 7/2012 Holmberg
2013/0180148 A1 7/2013 Rodgers et al.
2013/0263489 A1 10/2013 Troy
2013/0305579 A1 11/2013 Ward et al.
2014/0223791 A1 8/2014 Ruby et al.
2015/0176943 A1 6/2015 Iervolino
2016/0116249 A1 4/2016 Maugham
2016/0178314 A1 6/2016 Kielsmeier et al.
2016/0202016 A1 7/2016 Mather et al.
2016/0258713 A1 9/2016 Huang et al.
2016/0273873 A1 * 9/2016 Spyche, Jr. ..... F16F 9/18
2016/0273876 A1 9/2016 Barfoot et al.
2016/0305738 A1 10/2016 Huang et al.
2016/0327361 A1 11/2016 Roberts et al.
2016/0341518 A1 11/2016 Barfoot et al.
2016/0363415 A1 12/2016 Kielsmeier et al.
2017/0010065 A1 1/2017 Kielsmeier et al.
2017/0082394 A1 3/2017 Chow et al.
2017/0241737 A1 8/2017 Keller, II
2018/0003459 A1 1/2018 Miller et al.
2019/0128639 A1 5/2019 Parker et al.
2023/0022447 A1 * 1/2023 McWilliam ..... F41A 25/10

* cited by examiner

FIG. 22
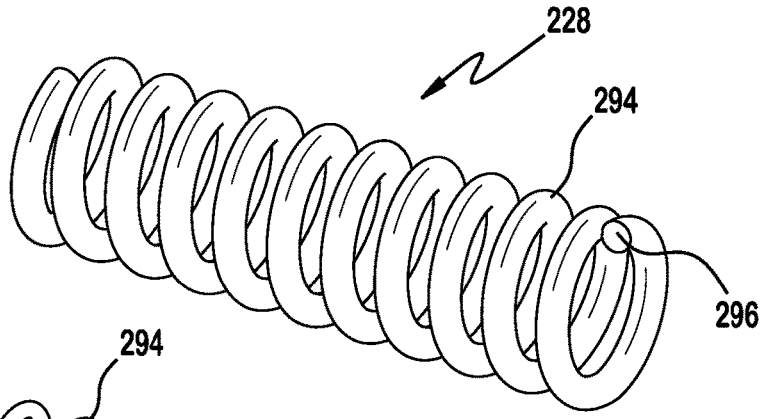
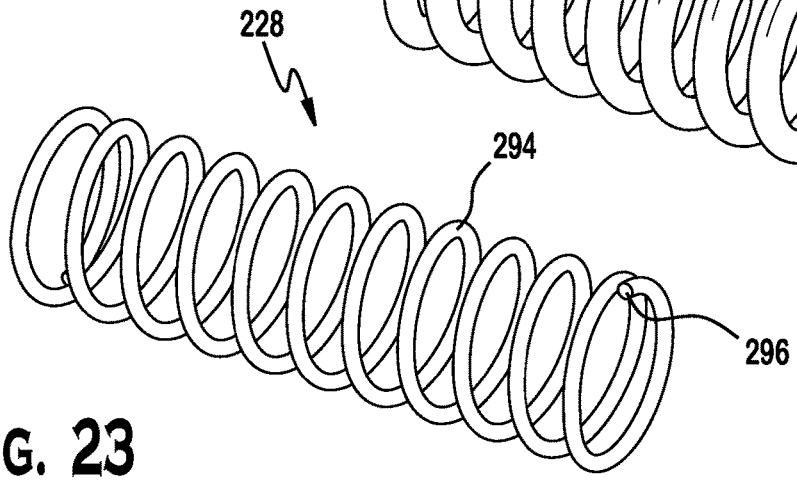
FIG. 23
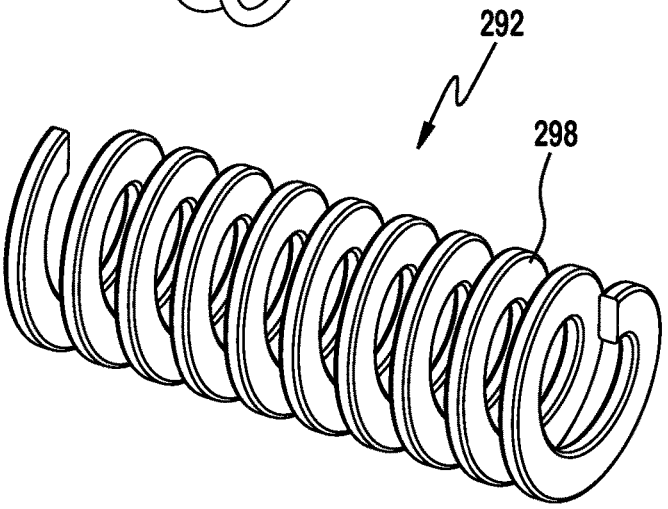
FIG. 24
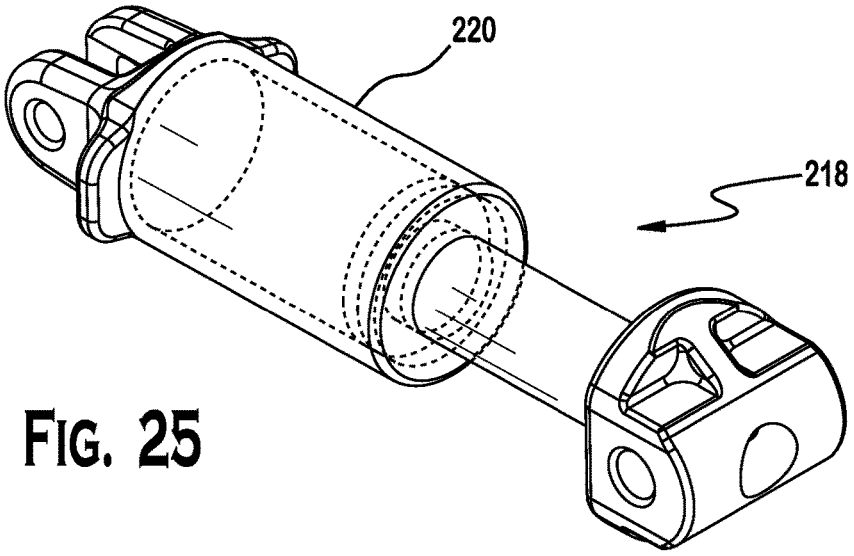
FIG. 25

STOCK FOR A SMALL ARMS WEAPON, RECOIL REDUCTION SYSTEM, AND METHOD

CROSS-REFERENCE TO RELATED APPLICATIONS

This application claims the benefit of U.S. Provisional Application No. 63/373,728 filed Aug. 28, 2022. This application is a continuation-in-part of U.S. patent application Ser. No. 29/866,097 filed Aug. 28, 2022. The entire disclosure of each of the U.S. Patent applications mentioned in this paragraph is incorporated by reference herein.

FIELD OF THE INVENTION

The invention generally relates to a stock for a small arms weapon. More particularly, the invention relates to a recoil reduction system for a firearm stock and a method for mitigating recoil in firearms.

BACKGROUND

Generally, recoil is the reactive force directed backward towards a firearm operator once a weapon has been fired. Firearm operators, including sportsman, law enforcement, and military personnel, may be equipped with weapon systems that produce high recoil energy. For example, an 8.5-pound shotgun shooting a nominal 1½-ounce, 1,200-fps buckshot load may generate about 31 ft-lbs. recoil energy. Additionally, an M4 carbine firing a XM95 non-lethal munition may produce approximately 69.2 ft-lbs. of recoil energy. Also, a M16A2 rifle firing a Rifle Launched Entry Munition (RLEM) may produce approximately 101.6 ft-lbs. of recoil energy. Excessive recoil can adversely impact a firearm operator's experience and performance. Also, a firearm operator may be physically injured by firing a weapon which generates recoil in excess of what the firearm operator's body can safely absorb or restrain. Additionally, excessive recoil can pose additional safety concerns if a firearm operator cannot adequately control the firearm during operation. Hence, a need exists for recoil-mitigating devices for small arms weapons.

SUMMARY

A stock for a small arms weapon is disclosed. The stock may include a recoil reduction system. The recoil reduction system may include a drive assembly and a recoil force storage apparatus. The drive assembly may include a latch bolt, a pin carrier and a drive link. The recoil force storage apparatus may include a rocker (or lever arm) and a recoil force storage device. The recoil force storage device may include a strut assembly. The strut assembly may include a coil spring. The recoil force reduction system may include three selectable operational modes. Each operational mode may provide a different level of recoil reduction. Each operational mode may be individually selected by configuring the recoil force storage apparatus in one of three operational arrangements.

DESCRIPTION OF THE DRAWINGS

In the accompanying drawings, which form part of this specification and are to be read in conjunction therewith and in which like reference numerals are used to indicate like parts in the various views:

FIG. 22 is a front, left side, top perspective view of an exemplary embodiment of a compression spring which may be used as a component of the strut assembly of FIG. 20;

FIG. 23 is a front, left side, top perspective view of another exemplary embodiment of compression spring which may be used as a component of the strut assembly of FIG. 20;

FIG. 24 is a front, left side, top perspective view of yet another exemplary embodiment of compression spring which may be used as a component of the strut assembly of FIG. 20;

FIG. 25 is a rear, right side, top perspective view of the strut of FIG. 20;

DESCRIPTION

Figure 1:
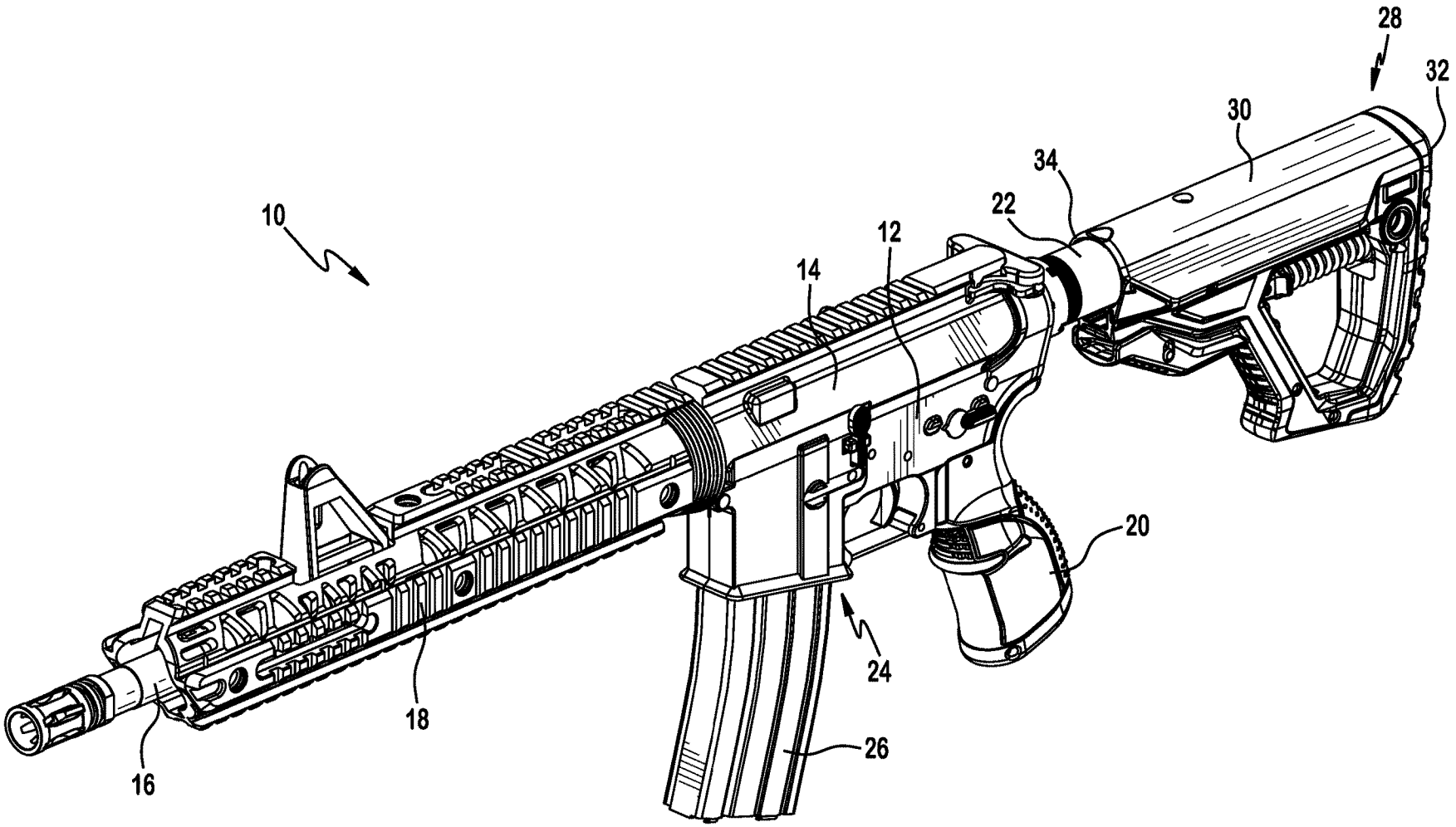
FIG. 1 is perspective view of an exemplary stock for a small arms weapon.

FIG. 1 shows an exemplary small arms weapon 10 which may include a lower receiver 12, upper receiver 14, a barrel 16, and a handguard 18. Additionally, the small arms weapon 10 may include a pistol grip 20 and a receiver extension 22. The lower receiver 12 further may include a magazine well 24. The magazine well 24 may hold an ammunition cartridge magazine 26. The small arms weapon 10 may further include a butt stock (or stock) 28 disposed on the receiver extension 22. The stock may include a stock body 30 having a proximal end 32, a distal end 34, and a longitudinal axis 35 extending from the proximal end 32 to the distal end 34.

Figure 2:
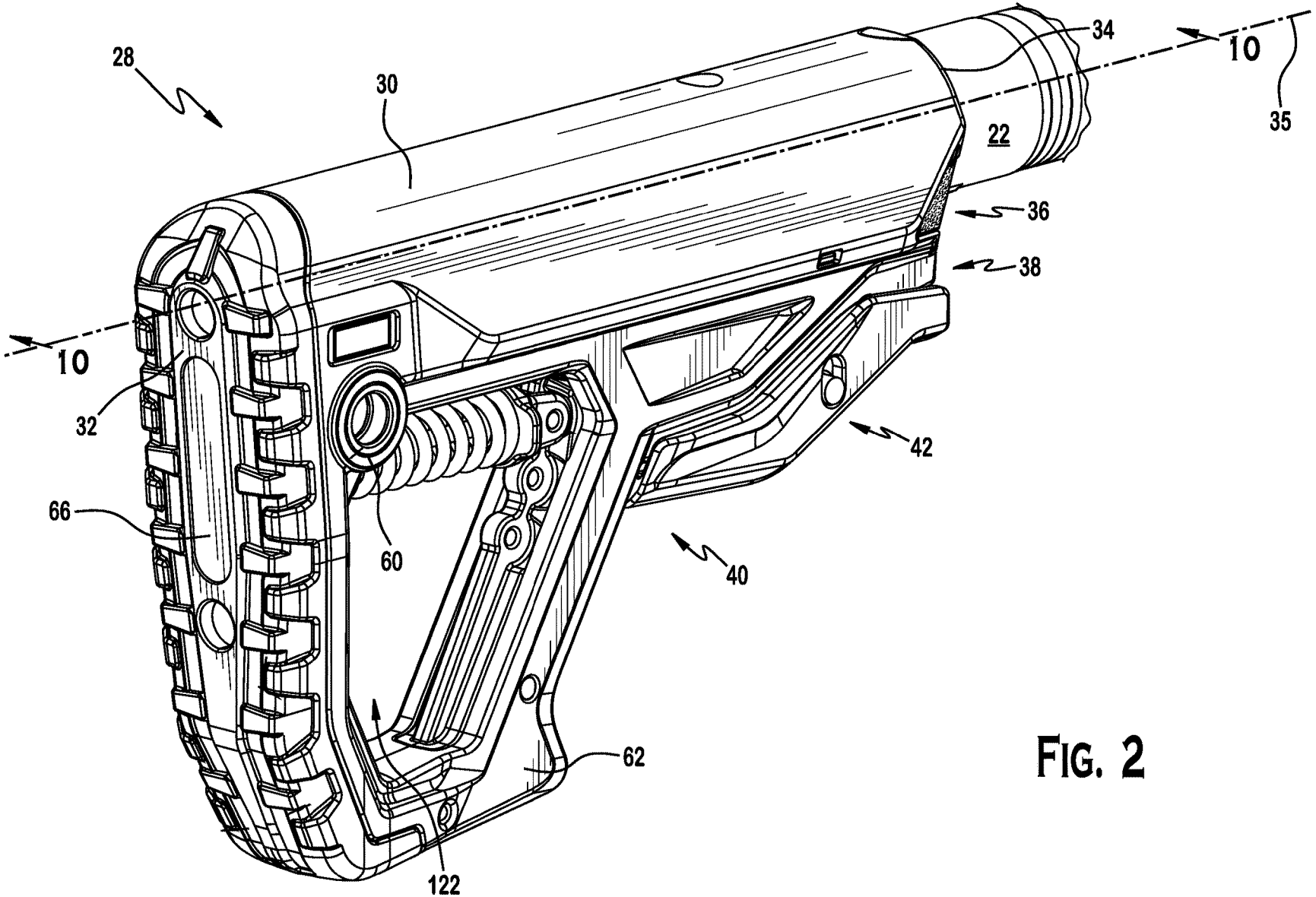
FIG. 2 is a rear, left side, top perspective view of the stock of FIG. 1.
Figure 3:
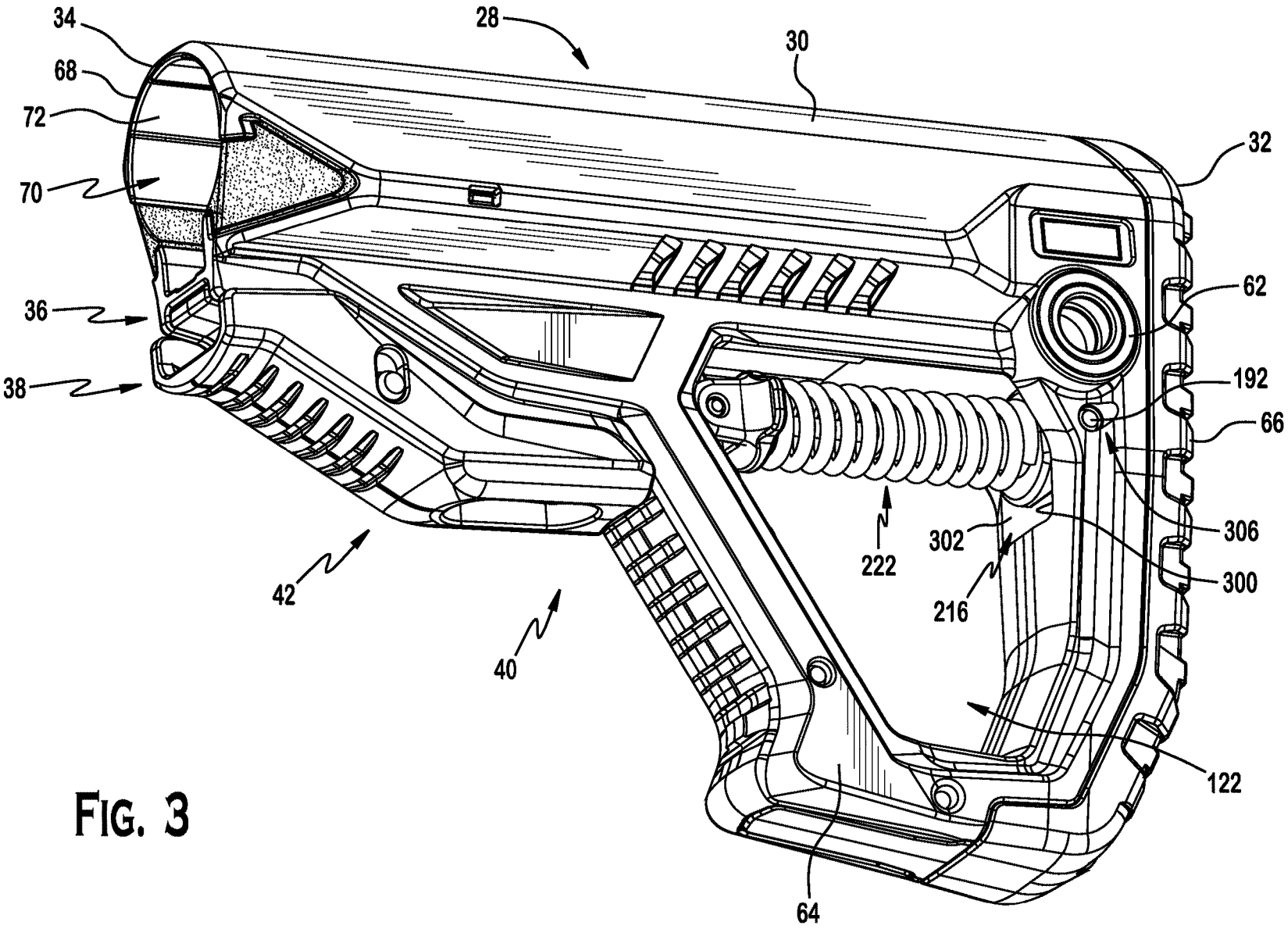
FIG. 3 is a front, right side, top perspective view of the stock of FIG. 1.
Figure 4:
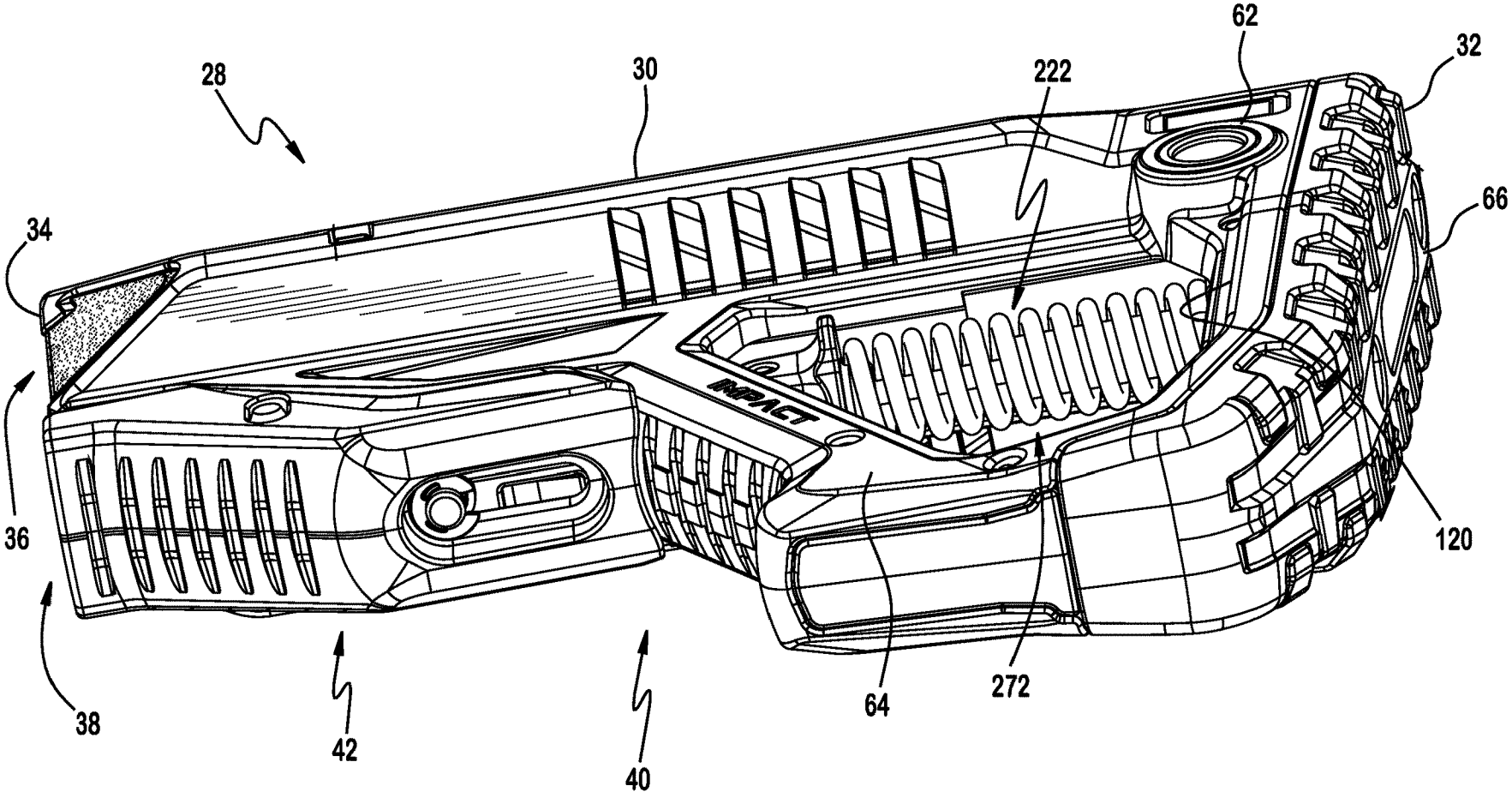
FIG. 4 is a rear, right side, bottom perspective view of the stock of FIG. 1.
Figure 33:
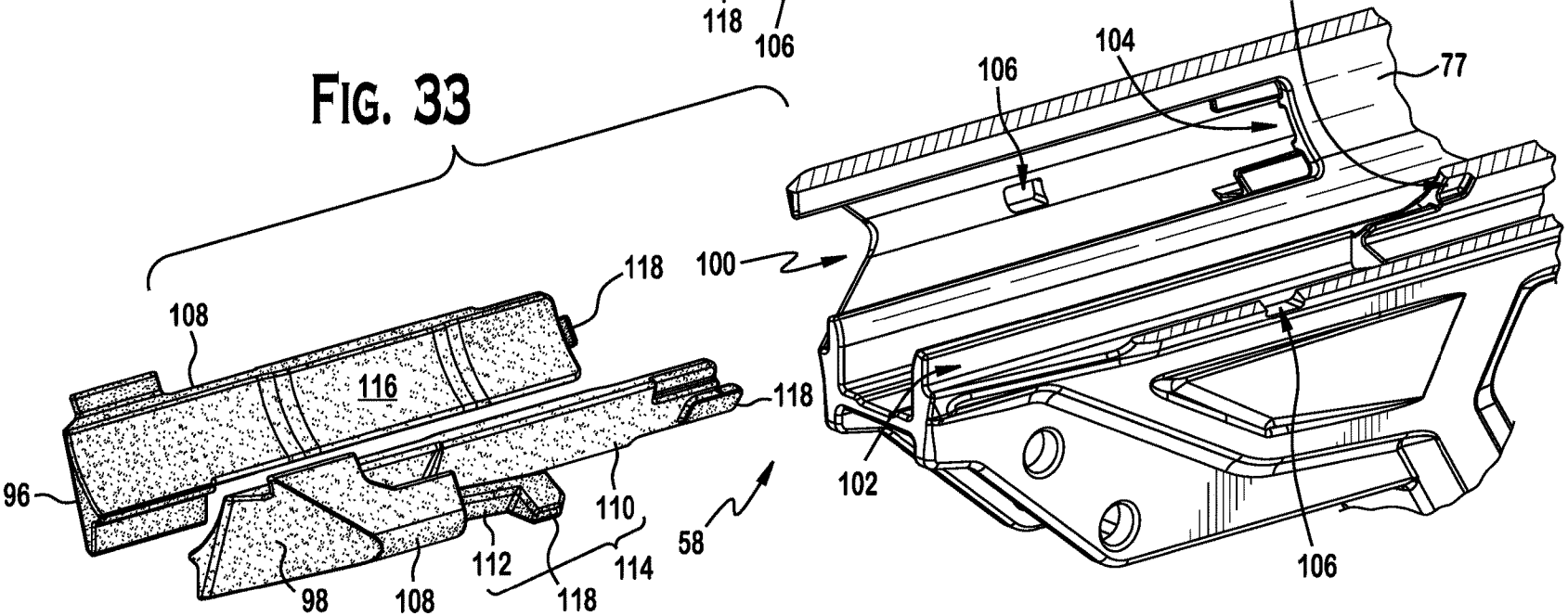
FIG. 33 is a cutaway view of front of the stock of FIG. 3, showing a partial exploded view of the port side shim, starboard side shim, and the respective associated shim receptacles.

Referring to FIGS. 2, 3 and 4, the stock body 30 may include a superior portion 36 and an inferior portion 38. The superior portion 36 may securely connect the stock body 30 to the receiver extension 22, and the inferior portion 38 may house the recoil reduction system 40. As shown on FIGS. 10-17, the inferior portion 38 further may include a stock positioning latch 42 for selectively coupling a latch bolt 44 to the receiver extension 22. The latch bolt 44 also may connect the recoil reduction system 40 to the receiver extension 12. The recoil reduction system 40 may include a drive assembly 46 and a recoil force storage apparatus 48. The drive assembly 46 may include a pin carrier 50 and a drive link 52. The recoil force storage apparatus 48 may include a rocker (or lever arm) 54 and a recoil force storage device (e.g., strut assembly) 56. Also, the recoil storage apparatus 48 may include a damper (not shown). Referring to FIG. 33, the stock body 30 also may include an anti-rattle mechanism 58.

Referring to FIG. 2 and FIG. 3, the stock body 30 further may include a quick disconnect mount (QD mount) 60 on the port side 62 and the starboard side 64. Also, the proximal end (or rear) 32 of the stock body may include a rubberized butt-pad 66. As shown in FIG. 3, the distal end (or front) 34 of the stock body 30 may include an opening 68 of a receptacle 70 which mates with the receiver extension 22. The receptacle 70 may include a sidewall 72 that extends from the opening 68 to an internal end wall 74 (see e.g., FIG. 8 and FIG. 10) located inside the stock body 30. The internal end wall 74 may be adjacent to the proximal end 32 of the stock body. In a preferred embodiment, the sidewall 72 and internal end wall 74 may substantially define a confines 76 (see e.g., FIGS. 8, and 10-11) in the receptacle 70 that is configured and dimensioned to telescopically receive a receiver extension 22.

Figure 29:
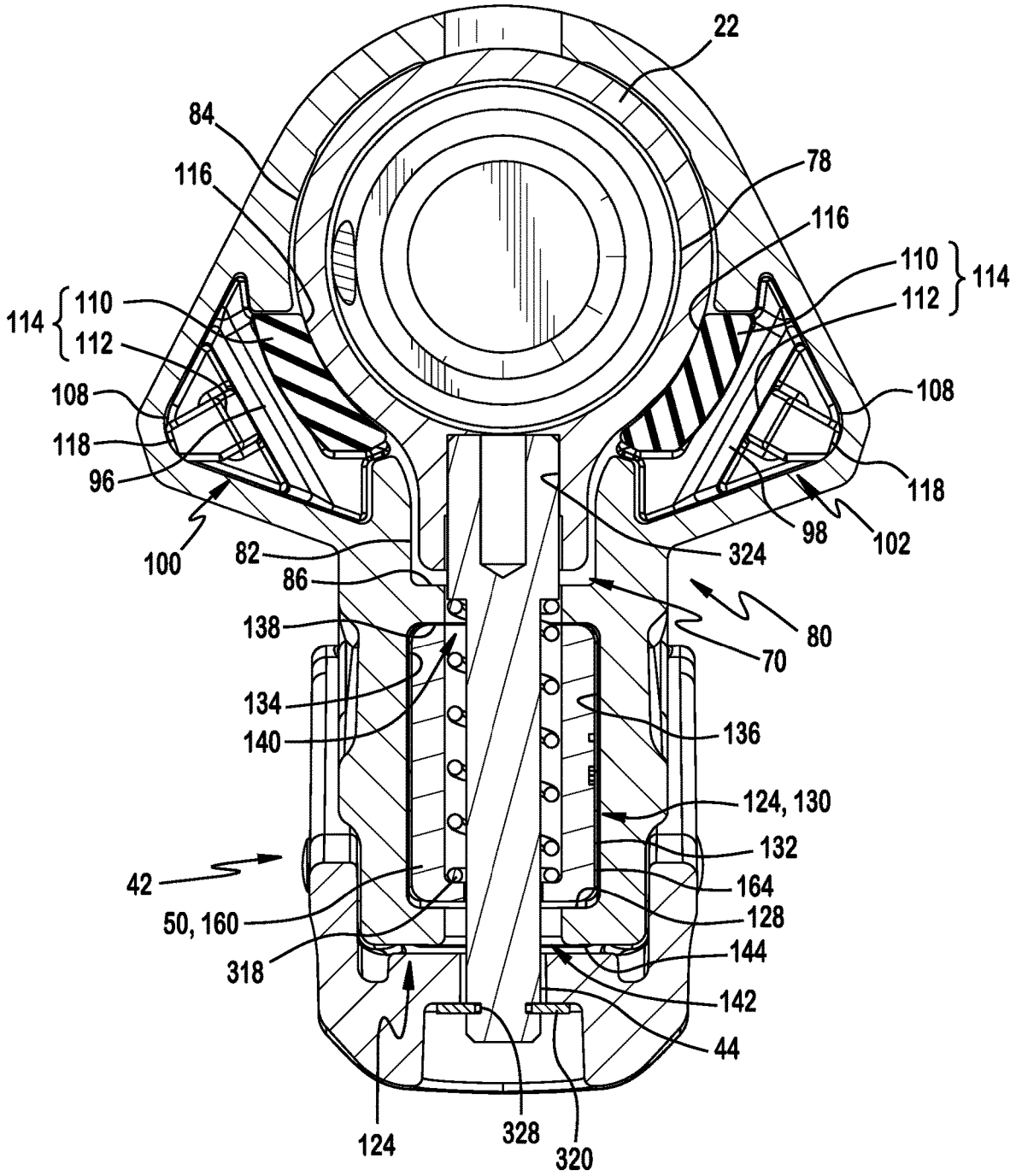
FIG. 29 is a cross-sectional view of the stock of FIG. 10 along line 29-29, showing a firearm buffer system, port and starboard resilient shims, a stock positioning latch, as well as drive assembly and rocker (or lever arm) inside the stock.
Figure 30:
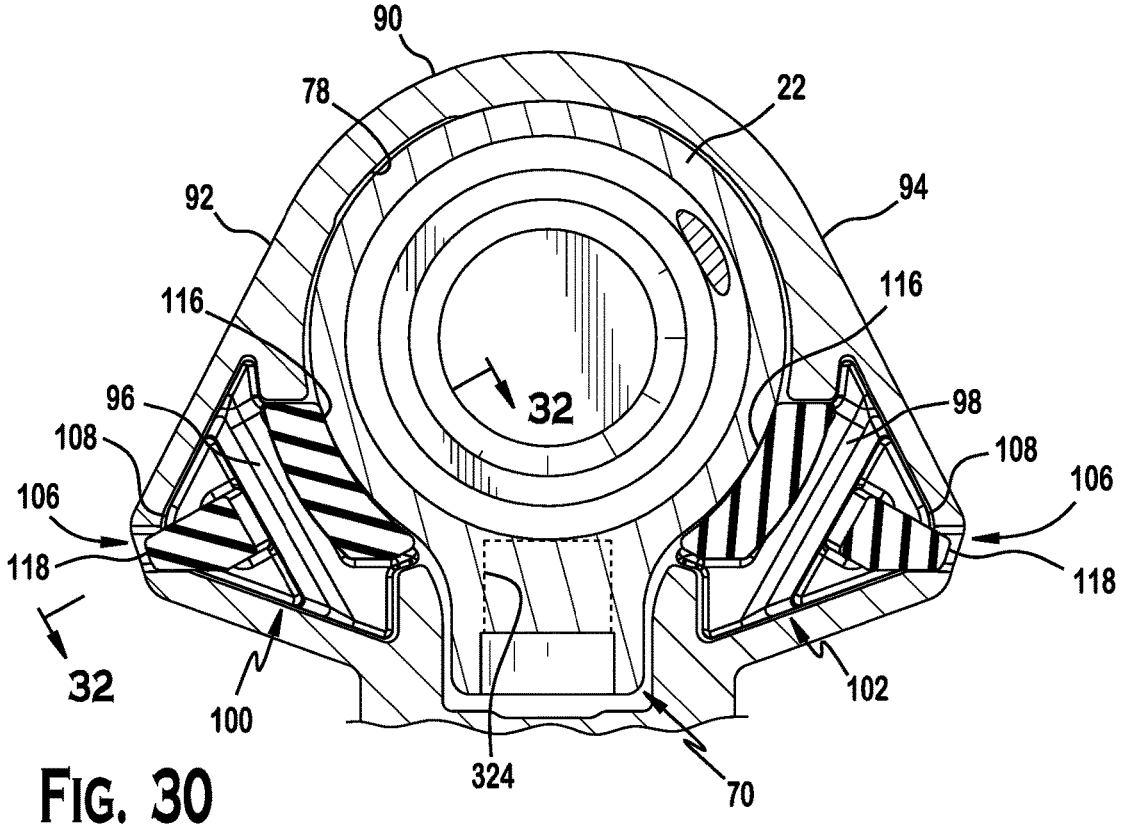
FIG. 30 is a partial sectional view of the stock of FIG. 10 along line 30-30, showing the firearm buffer system, as well as the arrangement of the port and starboard resilient shims.
Figure 31:
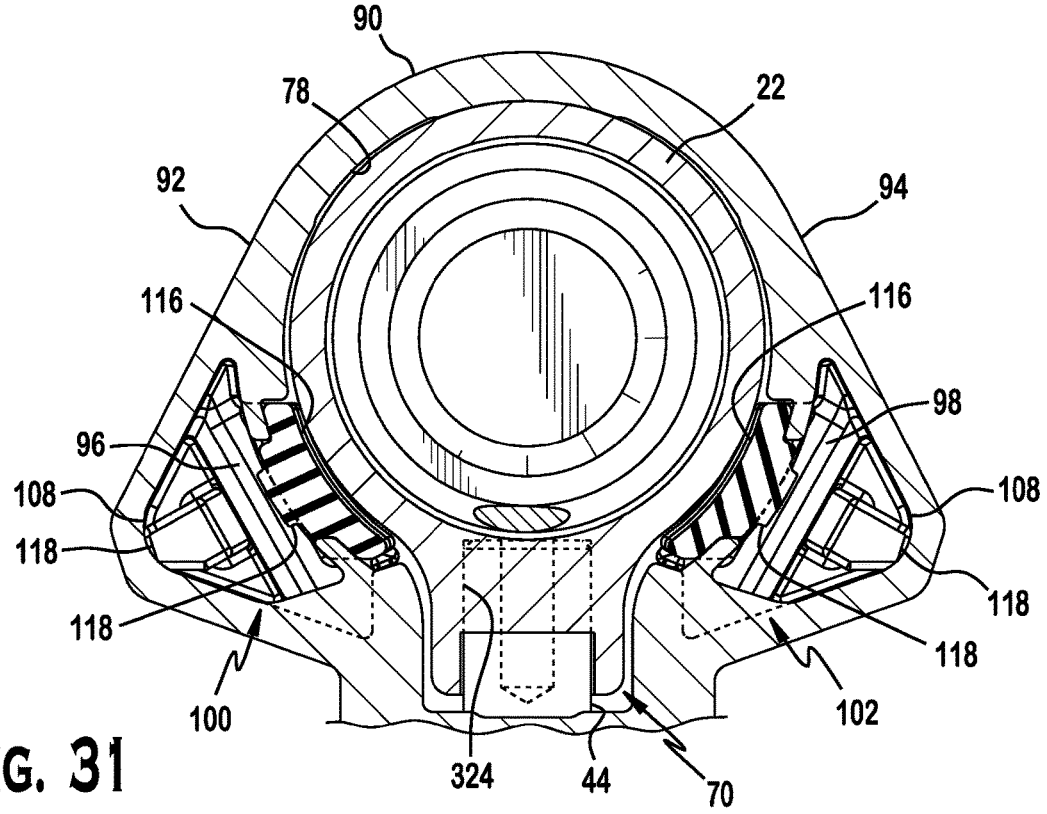
FIG. 31 is a partial sectional view of the stock of FIG. 10 along line 31-31, showing the firearm buffer system, as well as the arrangement of the port and starboard resilient shims.

Referring to FIG. 7 and FIGS. 29-31, the receptacle 70 may possess a cross-section 78 transverse to the longitudinal axis 35 of the stock body 35 that is complementary to the transverse profile of the receiver extension 22. The cross-section 78 may prevent rotation of the stock body 30 around the receiver extension 22. For example, as shown in FIG. 29, the profile 80 of the cross-section 78 may include a rectangular segment 82 and a generally circular segment 84. Referring to FIGS. 10-17, the base 86 of the receptacle 70 may define a datum line 88.

Figure 5:
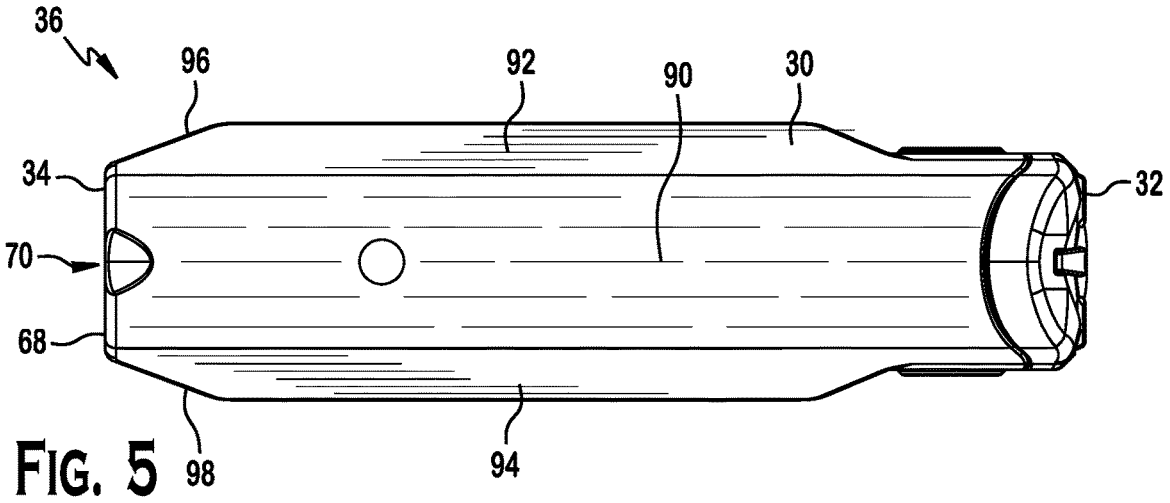
FIG. 5 is a top view of the stock of FIG. 1.
Figure 8:
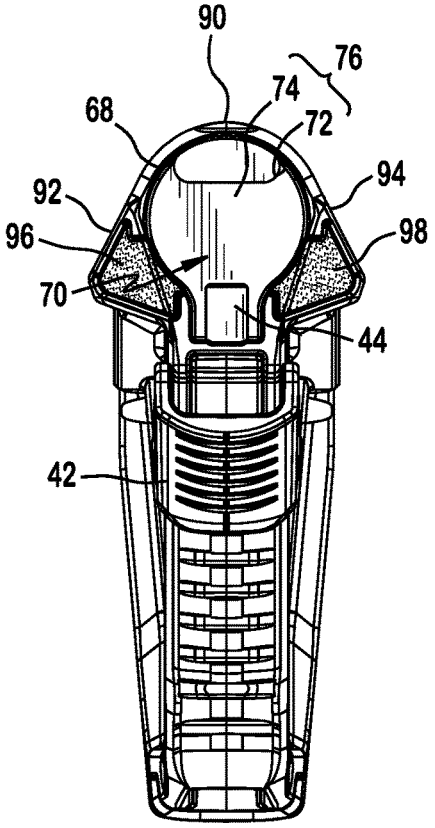
FIG. 8 is a front view of the stock of FIG. 1.
Figure 9:
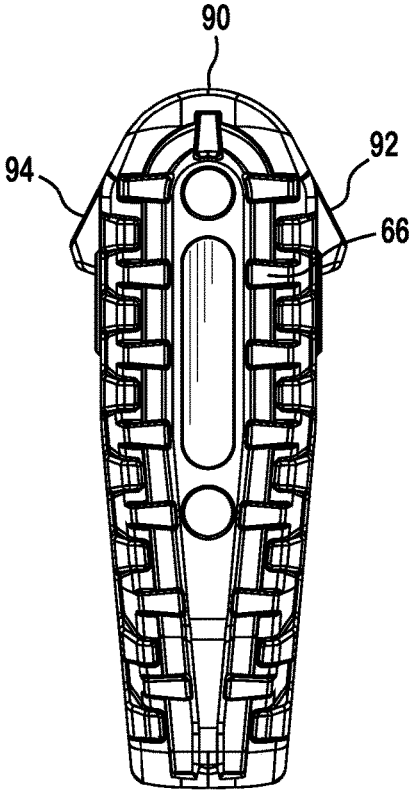
FIG. 9 is a rear view of the stock of FIG. 1.

Referring to FIG. 5 and FIG. 8, the superior portion 36 of the stock body 30 may contain the receptacle 70, and further may include a rounded crest 90, as well as a port side cheek rest 92 and a starboard side check rest 94. See also, FIG. 9. The port side cheek rest 92 and the starboard side check rest 94, respectively, may house a port side shim and 96 a starboard side shim 98. The port side shim and 96 a starboard side shim 98 may form part of the anti-rattle mechanism 58. See also, FIG. 29-33.

Figure 32:
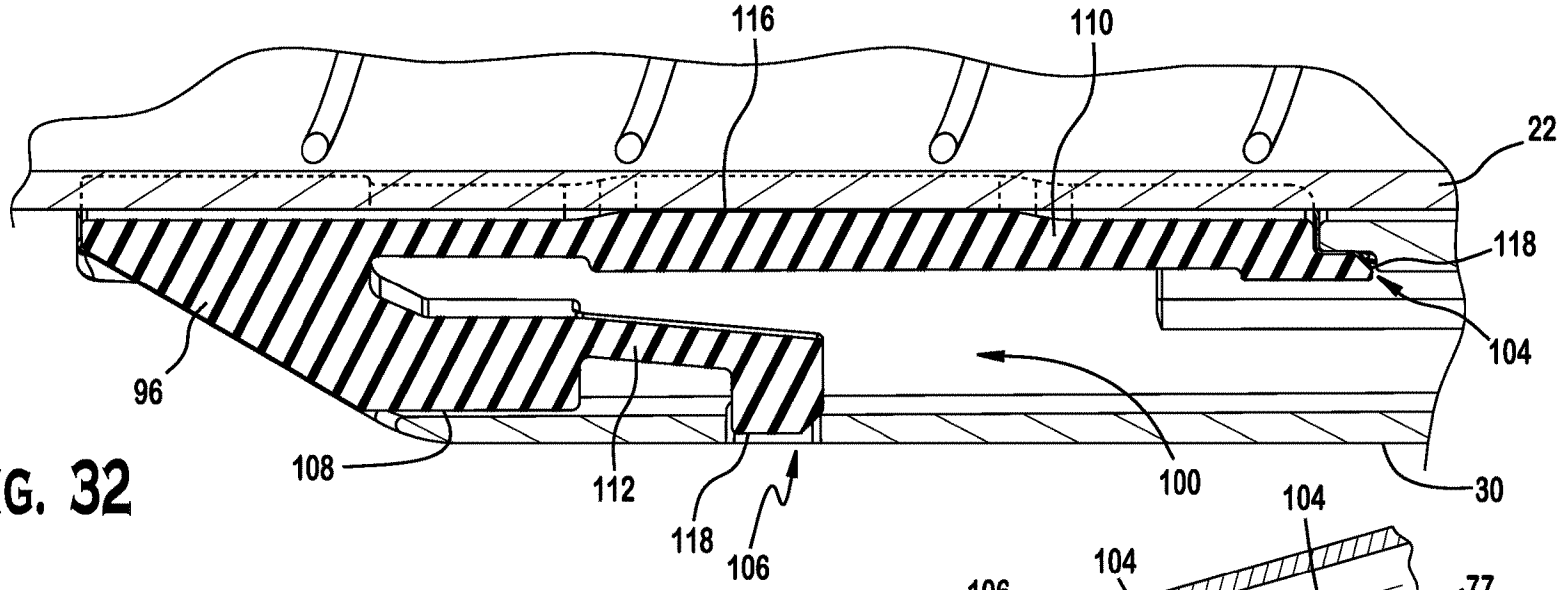
FIG. 32 is a partial sectional view of the stock of FIG. 30 along line 32-32, showing the firearm buffer system, as well as the arrangement of the port resilient shims.

Referring to FIG. 29, the receptacle 70 further may include a port side margin 100 and a starboard side margin 102 for receiving the port side shim 96 and the starboard side shim 98, respectively. As shown in FIG. 32 and FIG. 33, the port side margin 100 may include one recess 104 disposed in general alignment with the longitudinal axis and another recess 106 disposed in generally transverse alignment with the longitudinal axis. Generally, as shown in FIG. 33, the port side shim 96 and the starboard side shim 98 may each include a stem 108, a blade 110, and a finger 112. The stem 108 may form a distal portion of the shim, and the blade 110 and finger 112 may extend away from the stem to form a juxtaposed pair of elongated members 114.

Referring to FIGS. 29-32, the blade 110 may include a curved surface 116 which generally may conform to a segment of the receiver extension profile. The finger 112 may include one or more projections 118 that interlock with the sidewall of the margin. A receiver extension 22 in the receptacle 70 may press against and compress the port side shim 96 and the starboard side shim 98 when telescopically received within the receptacle to achieve a snug fit and to reduce vibration or movement between the stock and the lower receiver. Accordingly, the juxtaposed pair of elongated members 114 may form a resilient support for affecting a firm connection between the receptacle and a receiver extension disposed within the receptacle.

Figure 6:
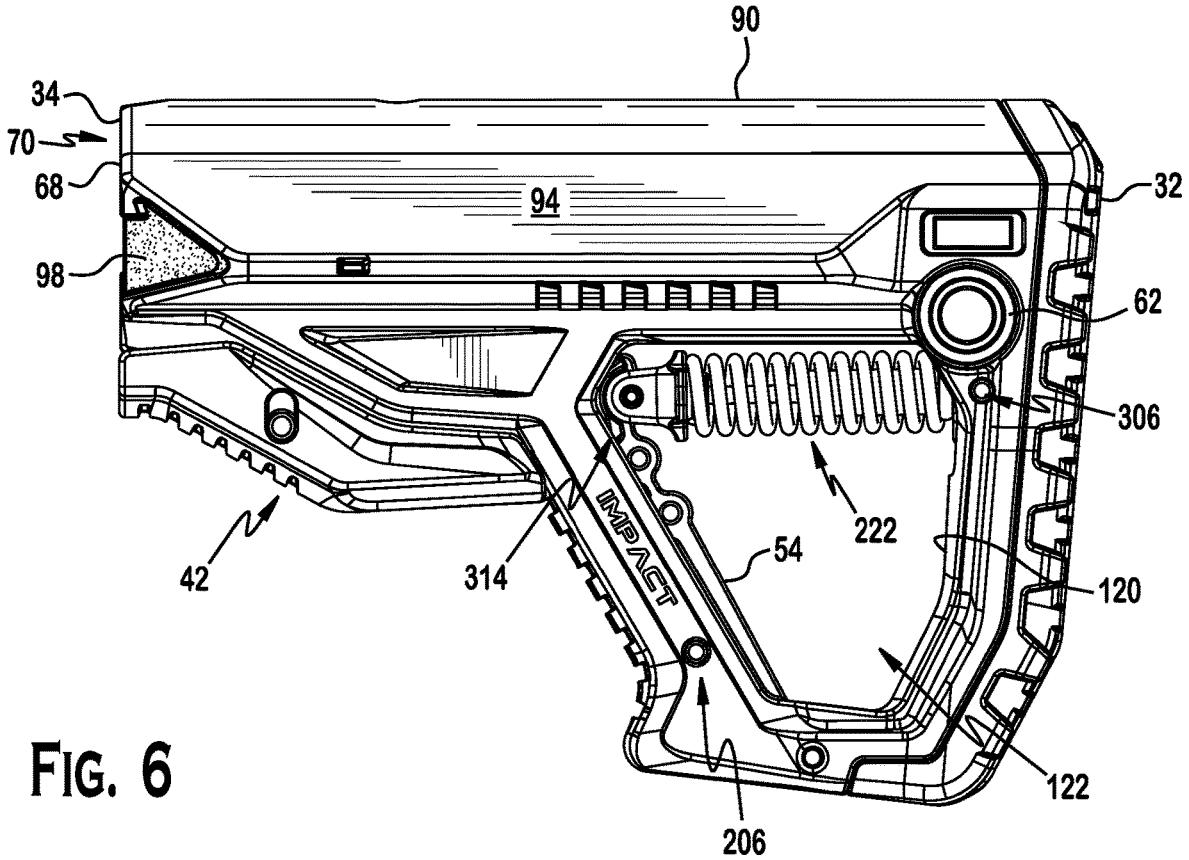
FIG. 6 is a right side view of the stock of FIG. 1.
Figure 7:
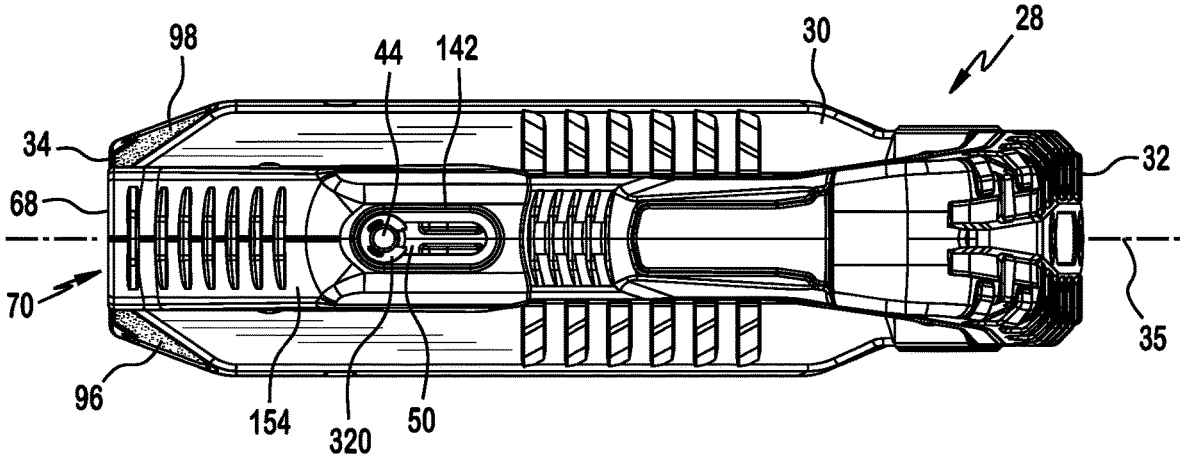
FIG. 7 is a bottom view of the stock of FIG. 1.
Figure 10:
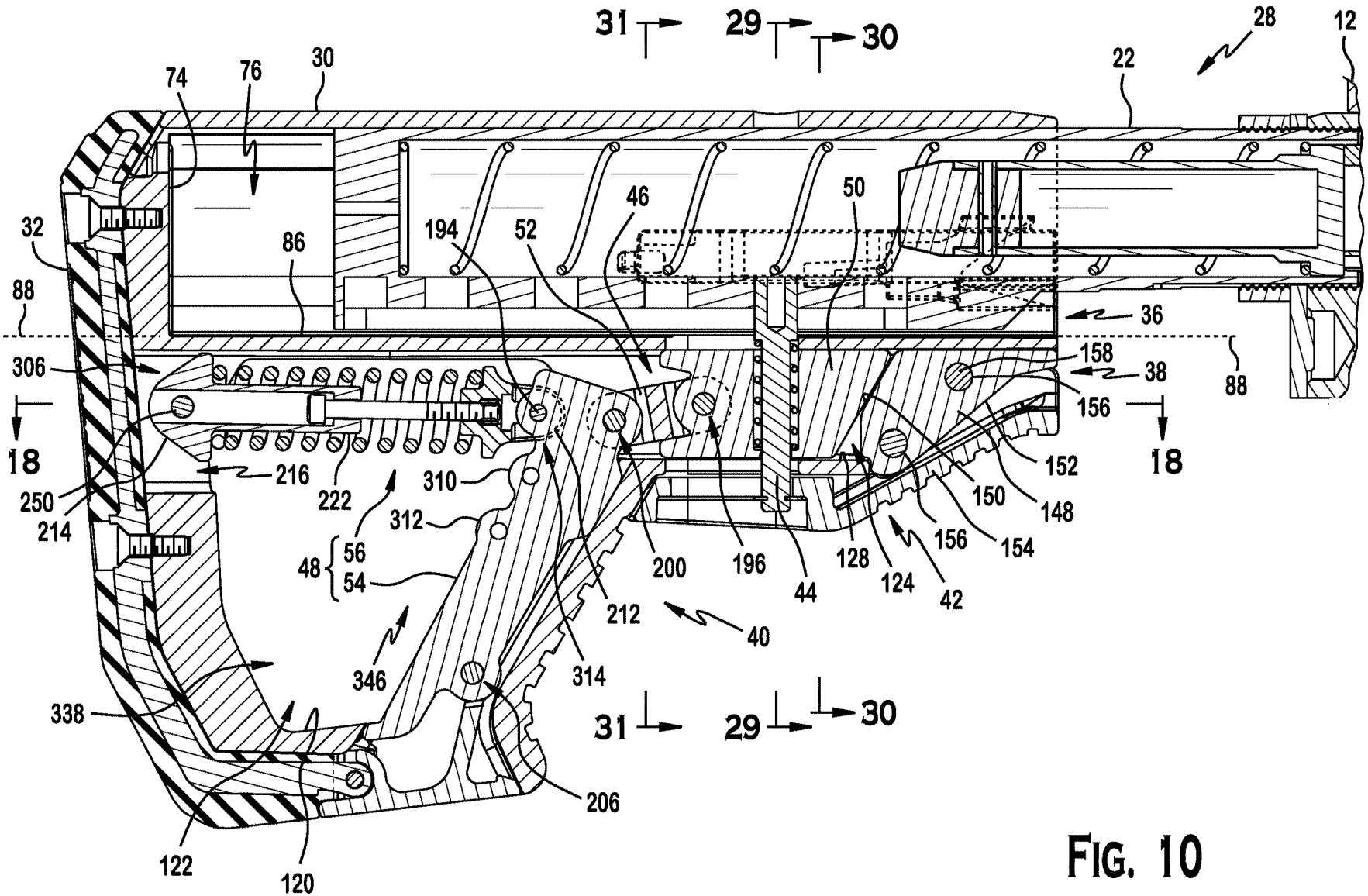
FIG. 10 is cross-sectional view of the stock of FIG. 5 along line 10-10, the stock being deployed on a receiver extension of a firearm, and the recoil reduction system being arranged in a first configuration.

Referring to FIGS. 3, 6 and 10, the stock body 30 further may include a frame 120 that defines a lateral passage 122 that extends from the port side 62 of the stock body to the starboard side 64 of the stock body.

Figure 28:
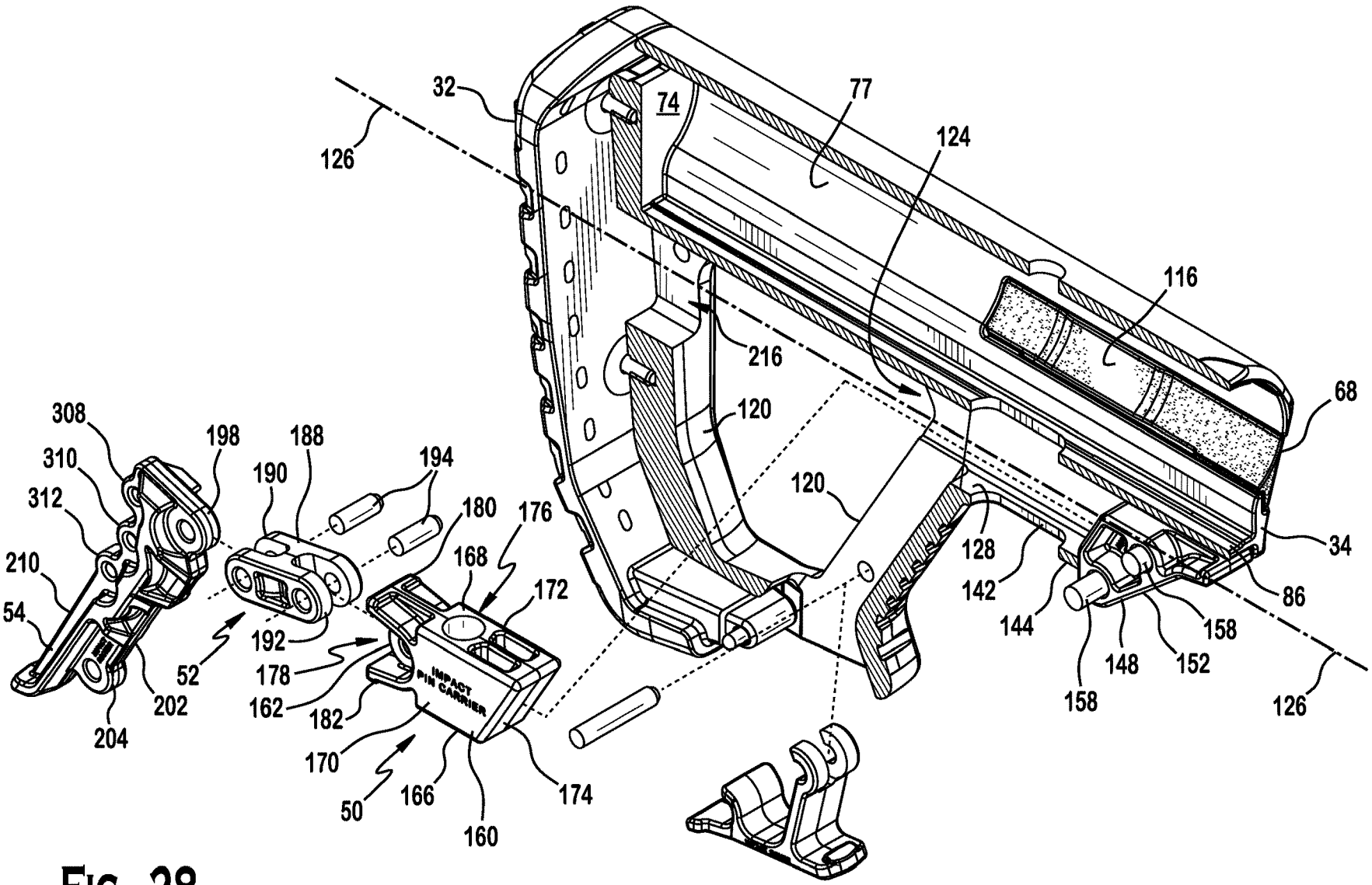
FIG. 28 is a cut away view of the stock of FIG. 2, showing a partial exploded view of the drive assembly and rocker (or lever arm).

Referring to FIG. 28, a duct 124 may be situated below the receptacle 70. The duct 124 may include a longitudinal axis 126 that is parallel to the longitudinal axis 35 of the stock body. Moreover, the duct 124 may include a base surface 128 which may be substantially flat and parallel to the datum line 88. See e.g., FIGS. 10 and 11. Preferably, as shown in FIG. 29, the duct 124 may possess a cross-section 130 transverse to the longitudinal axis 35 of rectangular shape. Although the duct 124 may define a cross-section 130 that includes a profile 132 of rectangular shape, the profile 132 may possess different shape provided that the drive assembly 46 may reliably transit the duct 124 and transfer kinetic energy (i.e. recoil forces) from the receiver extension 22 to the recoil force storage apparatus 56. For instance, the longitudinal duct 124 may possess a circular profile, a hex shaped profile, or a profile of another shape.

The duct 124 further may include a port sidewall 134, a starboard sidewall 136, and an upper surface 138. The upper surface 138 of the duct 124 may include a superior elongated slot 140. The superior elongated slot 140 may extend from the upper surface 138 of the duct to the base 86 of the receptacle 70. Also, the duct 124 may include an inferior elongated slot 142 that extends from the base surface 128 of the duct 124 to an inferior outer surface 144 of the stock body 30. The superior elongated slot 140 may be situated opposite the inferior elongated slot 142. As described below, a latch bolt 44 may be arranged through the superior elongated slot 140 and the inferior elongated slot 142 to form part of the recoil reduction system 40 and the stock positioning latch 42.

Referring to FIG. 10, the inferior portion 38 of the stock body 30 further may include a plug 148. For instance, the plug 148 may be disposed in or proximate to the duct 124 such that the duct may extend from the lateral passage 122 to the plug 148. Preferably, the plug 148 may include an inclined surface (or ramp) 150 facing the duct 124 and the lateral passage 122. Generally, the ramp 150 may be inclined at an acute angle with respect to the base surface 128 of the duct. For instance, the ramp 150 may be inclined at an approximately 60-degree angle with respect to the base surface 128 of the duct. Additionally, the plug 148 may include a tapered distal end 152 that is configured and dimensioned to be nested within a finger lever 154 of the stock positioning latch 42. Moreover, the port side and the starboard side of the plug 148 may include one or more attachment sites 156 for the finger lever 154. For instance, the plug 148 may include two transverse fastener holes which extend form the port side of the plug to the starboard side of the plug. One fastener hole may be a superior fastener hole, and the other fastener hole may be an inferior fastener hole. For example, a pin 158 may extend transversely through each of the respective fastener holes. For instance, in FIG. 26 and FIG. 29, the pin 158 in the superior fastener hole may serve as a fulcrum for the finger lever 154, and the pin in the inferior fastener hole may serve as a stop for restricting rotation of the finger lever 154 about the fulcrum.

Figure 26:
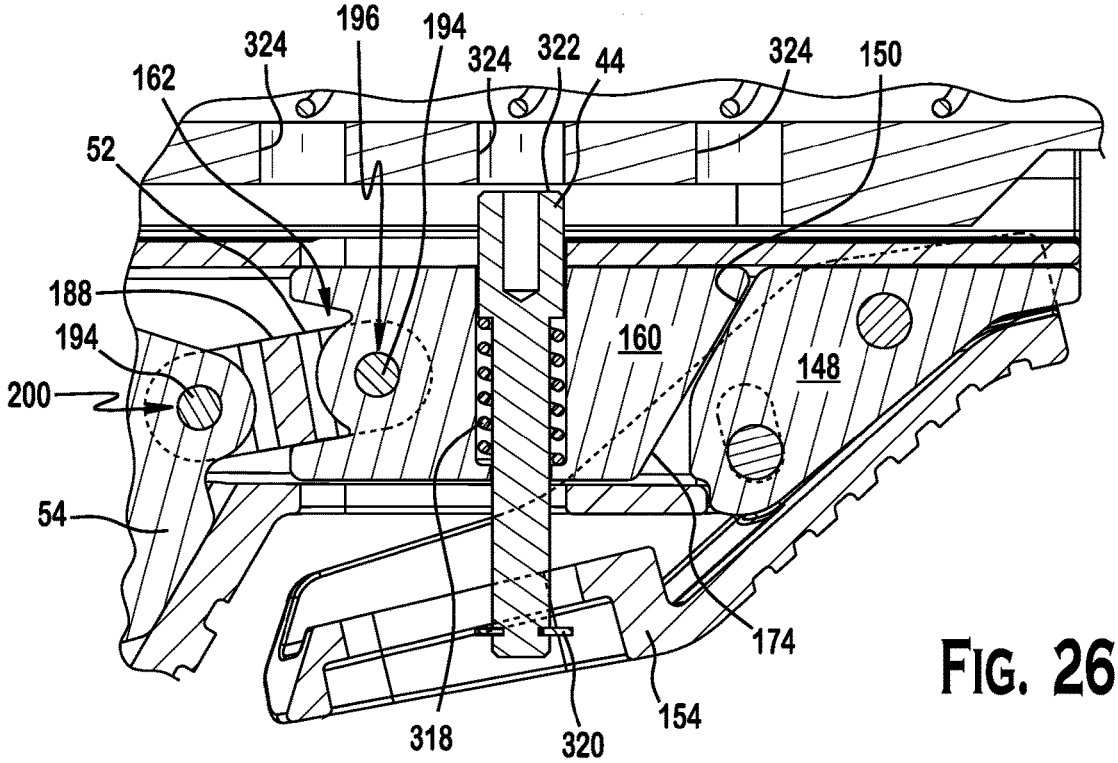
FIG. 26 is a partial sectional view of FIG. 10, showing the stock positioning latch in a retracted (or unlatched) configuration.
Figure 27:
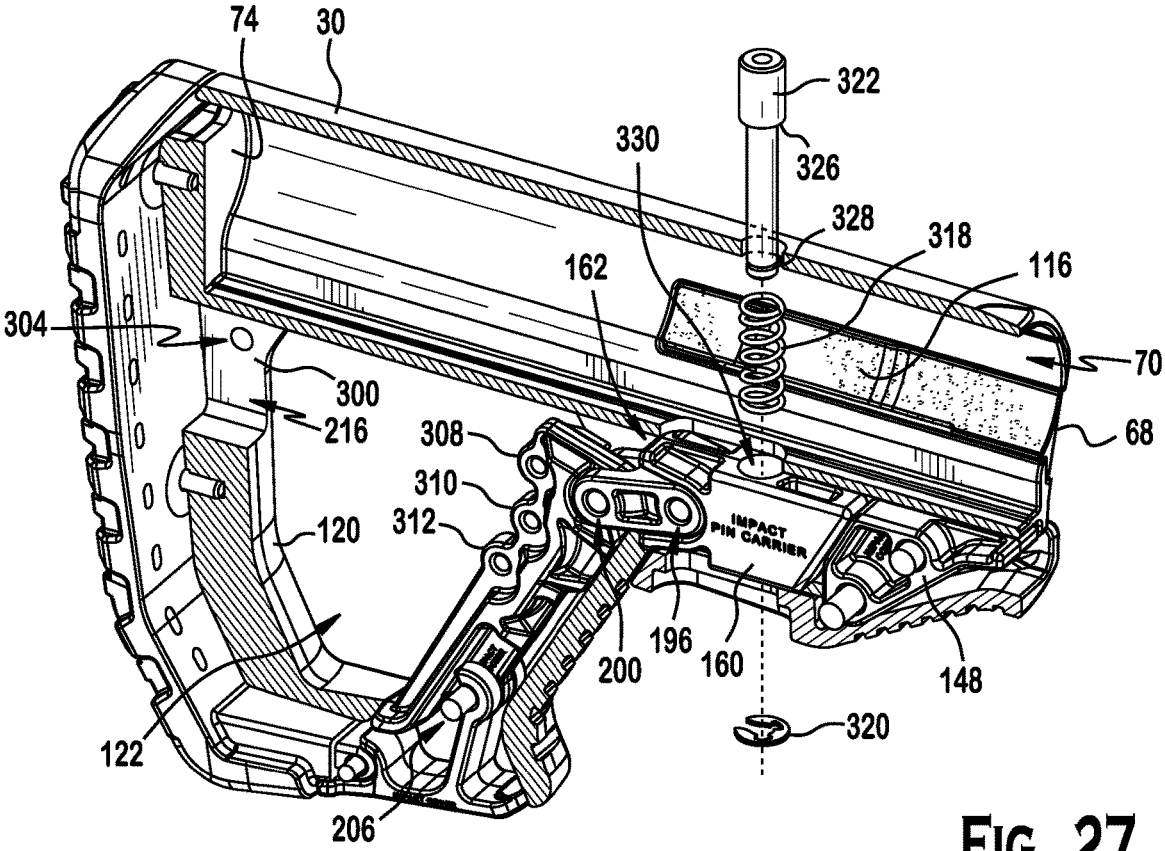
FIG. 27 is a cut away view of the stock of FIG. 2, showing a partial exploded view of the stock positioning latch, as well as the arrangement of the drive assembly and rocker (or lever arm).

Referring to FIGS. 10-17, the drive assembly 46 may be disposed in the duct 124 next to the plug 148. The drive assembly 46 may include a pin carrier 50 and a link 52 that is coupled to the pin carrier. Referring to FIG. 27 and FIG. 28, the pin carrier 50 may include a block 160 having a one-eye end 162. As shown in FIG. 29, the block 160 may include a cross-sectional profile 164 transverse to the longitudinal axis that is complementary in shape to the cross-sectional profile 130 of duct. The cross-sectional profile 164 may have rectangular shape. Referring to FIG. 28, the block 160 may include a lower surface 166, an upper surface 168 spaced from the lower surface, a port side surface 170, and a starboard side surface 172. The port side surface 170 and the starboard side surface 172 may each extend from the lower surface 166 to the upper surface 168. A front (or proximal) surface 174 also may extend from the lower surface to the upper surface. In FIGS. 26 and 27, the front surface 174 may form a complimentary ramp to the ramp 150 of the plug 148. Additionally, as shown in FIG. 28, the block 160 may include a countersunk bore 176 that extends from the upper surface 168 to the lower surface 166. The one-eye end 162 may be disposed distally on the block. The one-eye end 162 may be disposed within a channel 178. The channel 178 may be bound by a superior flange 180 and an inferior flange 182. The inner surface 184 of superior flange 180 and the inner surface 186 of the inferior flange 182 may define an acute angle. For example, the angle formed by the inner surface 184 of the superior flange and the inner surface 186 of the inferior flange may range from approximately 20 degrees to approximately 30 degrees. For instance, the angle formed by the inner surface 184 of the superior flange and the inner surface 186 of the inferior flange may be approximately 22 degrees.

The drive link 52 may include a structural member 188 having a proximal two-eye end 190 and a distal two-eye end 192. The distal two-eye end 192 may be configured and dimensioned to mate with the one-eye end 162 of the pin carrier 50 and a fastener (e.g., a knuckle pin) 194 to form a distal joint 196. Referring to FIG. 10-17, the axis of rotation $AOR_1$ of the distal joint 196 may be transverse to the longitudinal axis 126 of the duct 124. The proximal two-eye end 190 of the drive link may be configured and dimensioned to mate with a superior eye 198 of the rocker (or lever arm) 54 and a fastener (e.g., a knuckle pin) 194 to form a proximal joint 200. The axis of rotation $AOR_2$ of the proximal joint 200 may be parallel to the axis of rotation AOR1 of the distal joint 196. Generally, the drive link 52 may transfer recoil force(s) from the pin carrier 50 to the recoil force storage apparatus 48.

Referring to FIGS. 6, 10, 27 and 28, the recoil force storage apparatus 48 may be housed in the frame 120. For example, the rocker (or lever arm) 54 may be pinned to the frame 120 on the distal side of the lateral passage 122 and partially disposed in the lateral passage 122. More particularly, the rocker (or lever arm) 54 may include a plurality of eyes. For example, in FIG. 28, the rocker (or lever arm) 54 may include a distal side 202 which includes a superior eye 198 and an inferior eye 204. The superior eye 198 may be pinned to the drive link 52, and the inferior eye 204 may be pinned to the stock body 30 to form an inferior joint 206 (see e.g., FIG. 10). The inferior joint 206 may pivotably secure the rocker (or lever arm) 54 to the frame 120. Referring to FIGS. 27-28, the rocker (or lever arm) 54 further may include three eyes 308, 310, 312 on the proximal side. As shown in FIG. 10, one eye 308 of the three eyes 308, 310, 312 on the proximal side 210 of the rocker (or lever arm) 54 may be pinned to the distal end 212 of the recoil force storage device (e.g., a strut assembly) 56. The proximal end 214 of the recoil force storage device 56 may be pinned to the frame 120 in a recess 216 on the proximal side of the lateral passage 122.

The recoil force storage apparatus 48 further may include a damper (not shown). Generally, a damper may be any mechanical device suitable for dissipating recoil forces produced by the firearm. For instance, a damper may include a pneumatic or hydraulic spring or a shock absorber—alone or in combination with a resilient member (e.g., a coil spring))—to dissipate recoil forces from the firearm. For example, a damper may include a hydraulic piston or air cylinder. For instance, a suitable damper may include a coilover, smooth body, or air spring type shock absorber. Additionally, the damper may be an adjustable-type shock absorber.

Figure 20:
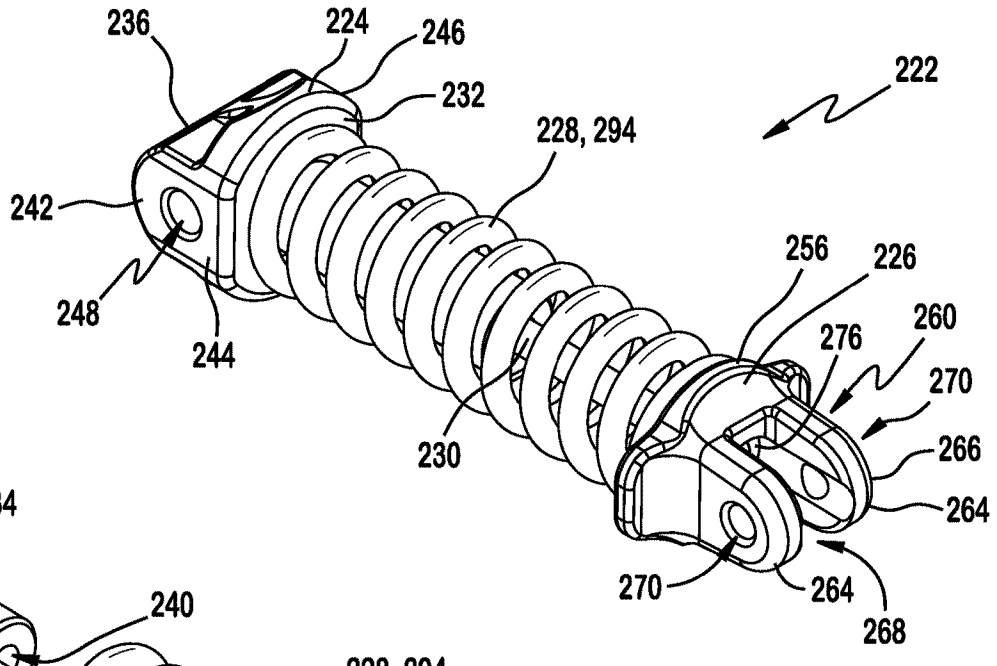
FIG. 20 is a front, left side, top perspective view of an exemplary embodiment of a strut assembly.
Figure 21:
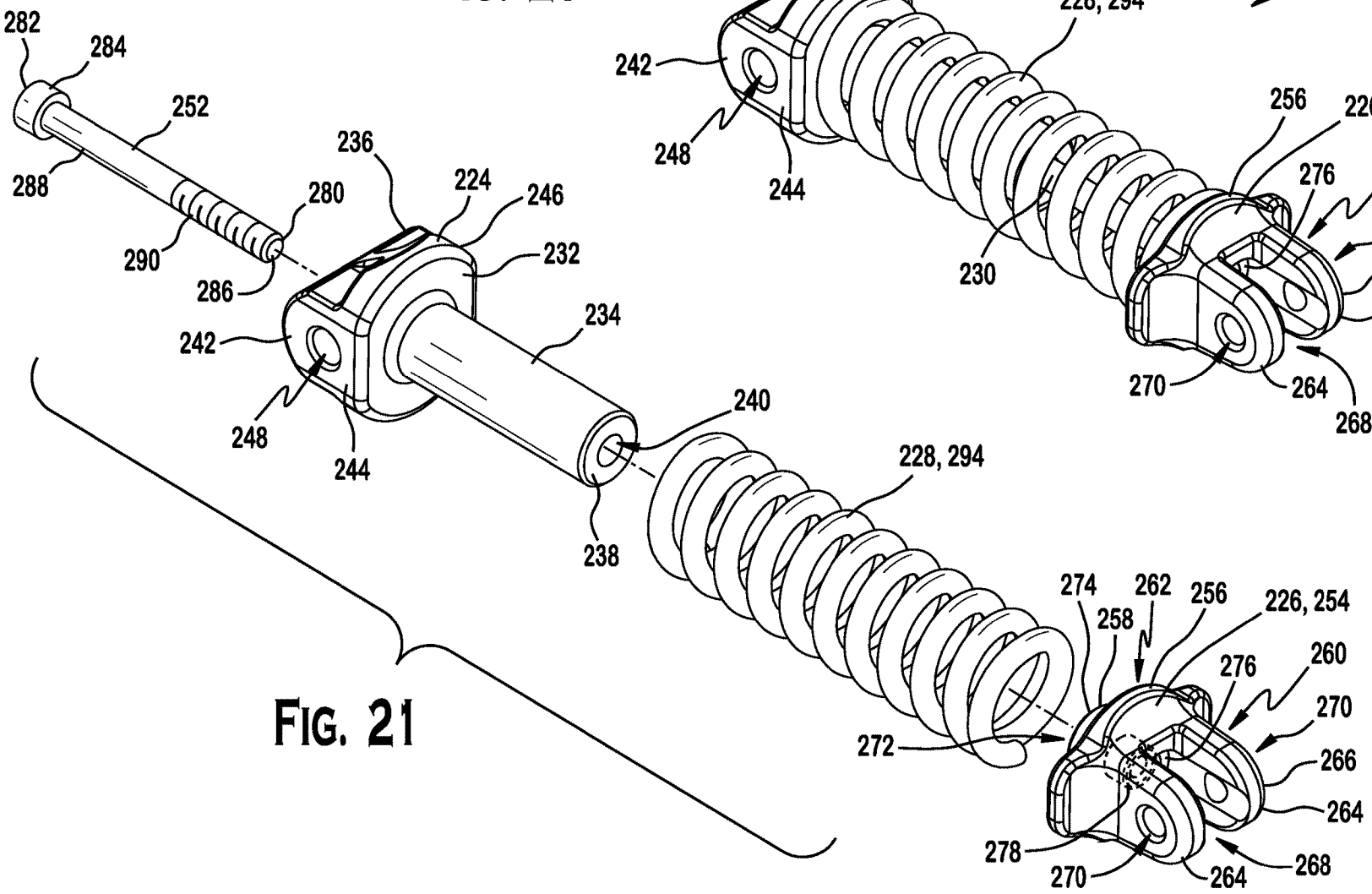
FIG. 21 is an exploded view of the struct assembly of FIG. 20.

Referring to FIGS. 10, and 18-21, the recoil force storage device 56 may include a strut assembly 222. As shown in FIG. 20 and FIG. 25, the strut assembly 222 may include a strut insert 224, a struct mount 226, coil spring 228, and a fastening element 230. As shown in FIG. 21, the strut insert 224 may include a spring seat 232 and a spring guide 234. The strut insert 224 may include a proximal end 236, a distal end 238, and a central bore 240 which extends from the proximal end 236 to the distal end 238. The bore 240 may be a counter bore. See e.g., FIG. 10. The proximal end 236 of the strut insert may include a one-eye end 242. The one eye-end 242 may include a port side 244 and a starboard side 246. A fastener receiving bore 248 may extend from the port side 244 to the starboard side 246. The fastener receiving bore 248 may intersect the central bore 240. The fastener receiving bore 248 may be configured and dimensioned to receive a fastener (e.g., a bolt or pin) 250 which allows the struct insert 224 to rotate about the fastener 250. Also, the central bore 240 may be configured and dimensioned to receive a longitudinal fastener 252. The longitudinal fastener 252 may include a distal end 280 and a proximal end 282. A head 284 may be disposed at the proximal end 282 of the longitudinal fastener 252, a tip 286 may be disposed at the distal end 280, and a shank 288 may be disposed between the head and the tip. The shank may include a screw thread 290.

The strut mount 226 may include a flange body 254 having a proximal side and a distal side. The flange body may include an intermediate flange 256 with a raised portion (e.g., a disk) 258 on the proximal side and a fork 260 on the distal side. The proximal side may define a spring seat 262 and the fork 260 may include a pair of tines 264 which define a two-eye end 266. For example, one tine may be a port side tine and the other tine may be a starboard side tine. The tines 264 further may define a channel 268 for receiving a one-eye end of another structural member (e.g., one of the three one-eye ends disposed on the proximal side of the rocker). Also, each of the tines 264 may include a through hole 270. For example, the port side tine may include a lateral through hole and the starboard side tine may include a lateral through hole. The through holes may be aligned. Further, the port side through hole and the starboard side through hole may be configured and dimensioned to receive an axial fastener (e.g., a knuckle pin) 194 which may secure a one eye-end to the two-eye end 266 and form a joint. See e.g., FIGS. 10-17; front joint 314. The strut mount 226 may further include a bore 272 that extends from the proximal end 274 to the distal end 276. The bore 272 may be a countersunk bore. A nut 278 may be positioned in the countersunk bore. The nut 278 may be configured and dimensioned to mate with the screw thread 290 of the longitudinal fastener 252.

Referring to FIGS. 20-21, the coil spring 228 may be a compression spring. For instance, the coil spring 228 may be formed by a round wire coil 294. For example, the coil spring 228 may have an inner diameter of approximately 8 mm and an outer diameter of approximately 16 mm, and the wire 296 may have a diameter of approximately 3.0 mm. See e.g., FIG. 22. In another example the wire 296 may have a diameter of approximately 2.4 mm. See e.g., FIG. 23. Although the diameter of the wire typically may range from approximately 2 mm to approximately 4 mm, other wire diameters may be used for a particular stock configuration or application, provided that the spring is configured and dimensioned to reliably operate as part of the recoil force storage apparatus 48. Similarly, other inner and outer coil spring diameters may be used for a coil spring in a particular stock configuration or application.

Figure 35:
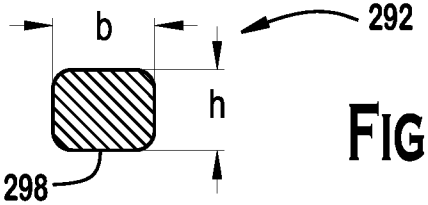
FIG. 35 is a diagram showing a wire cross-section of the spring design of FIG. 34.

Referring to FIG. 24 and FIG. 35, the coil spring 228 may be formed from a wire having noncircular cross-section. For example, the cross-section of the wire may have rectangular shape. For instance, as shown in FIG. 35, the rectangular shape may have a width b and a height h. In an exemplary embodiment, the width b may be approximately 3.1 mm and the height h may be approximately 2.5 mm. Alternatively, the cross-section of the wire may have an oval, square, trapezoid (or "keystone"), sharp triangle, wedge, equilateral triangle, pie, half round or other shape. Also, the coil spring may be formed from a stranded wire. Generally, the wire for the coil spring may be made of spring steel. For instance, the spring steel may be music wire (e.g., ASTM A228), rocket wire or other suitable material. For example, a suitable material may be high strength alloys having a Young's Modulus, E, of approximately $190\times10^3$ MPa at standard temperature and pressure. For instance, the spring steel may be a carbon steel alloy or a chrome silicon alloy.

Figure 34:
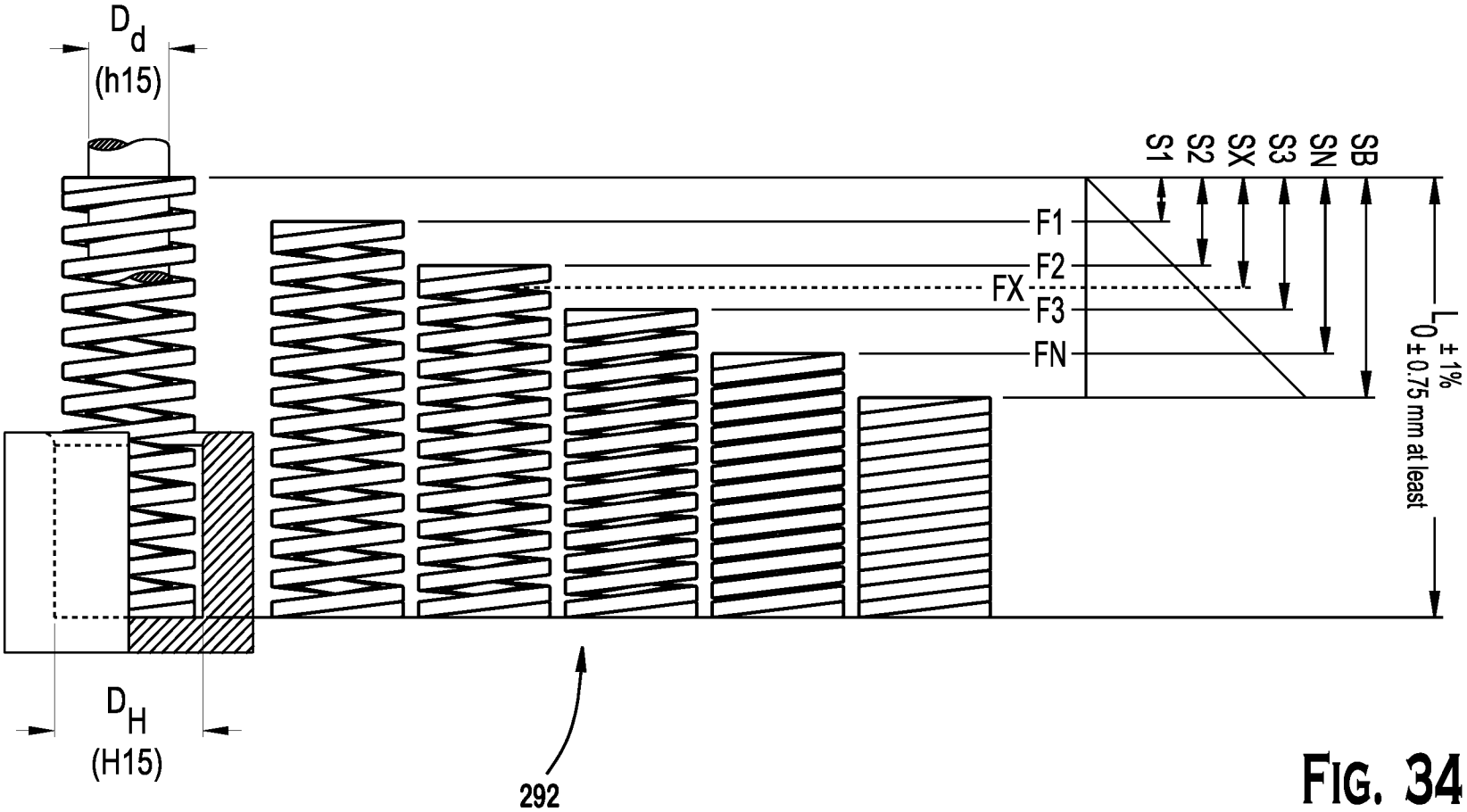
FIG. 34 is a diagram showing an exemplary spring design for the strut assembly coil spring.

Referring to FIG. 34, the coil spring 228 may have an inner coil diameter DD of approximately 8 mm and an outer coil diameter DH of approximately 16 mm. Generally, the coil spring may include approximately 12 to 14 coils and possess a free length that ranges from approximately 45 mm to 55 mm. Also, the coil spring may possess a spring constant that ranges from approximately 33 N/mm to approximately 41 N/mm. Preferably, the coil spring 228 may possess a free length LO of approximately 51 mm and a spring constant RG of approximately 37.1 N/mm. Moreover, in this embodiment the solid height of the coil spring (or fully closed length) (i.e., LO−SB) may be approximately 32 mm. Generally, the coil spring may be formed from spring steel such as or similar to steel wire described in ASTM A228/A228M-18. Preferred values for the coil spring design of FIG. 34 are presented in Table 1 (below).

As shown in Table 1 and FIG. 34, the coil spring may have a first working deflection S1 (m). The spring force F1 (N) for the first working deflection may be approximately 378 N (i.e., S1×RG). The length of the coil spring at the first working deflection S1 may be equal to LO minus S1 or 40.8 mm. Additionally, the coil spring may have a maximum design (or fourth) operating deflection SN (m). The spring force (N) for the maximum design operating deflection may be approximately 568 N (i.e., SN×RG). The length of the coil spring at the maximum design operating deflection SN may be equal to LO minus SN or 35.7 mm.

TABLE 1

Exemplary Coil Spring Design Values

| Parameter | Units | Exemplary Value |
|---|---|---|
| Hole diameter, DH | mm | 16 |
| Rod diameter, DD | mm | 8 |
| Free length, LO | mm | 51 |
| Spring constant, RG (a) | N/mm | 37.1 |
| Length at compression end, LX | mm | 51 |
| First working deflection, S1 (b) | mm | 10.2 |
| Force for S1, F1 | N | 378 |
| Second working deflection, S2 (c) | mm | 12.8 |
| Force for S2, F2 | N | 475 |
| Third working deflection, S3 | mm | 14.0 |
| Force for S3, F3 | N | 520 |
| Fourth working deflection, SN (d) | mm | 15.3 |
| Force for SN, FN | N | 568 |
| Solid deflection, SB | mm | 18.9 |
| Cross wire section, BXH | mm | 3.1 × 2.5 |
| Wire material | — | Spring steel |

Notes:
(a) Tolerance +/− 10%.
(b) Recommended working deflection for long spring life.
(c) Recommended working deflection for medium spring life.
(d) Maximum operating deflection.

Moreover, the coil spring may have a second working deflection S2 (m) of approximately 12.8 mm. The spring force F2 (N) for the second working deflection may be approximately 475 N (i.e., S2×RG). The length of the coil spring at the second working deflection S2 may be equal to LO minus S2 or approximately 38.2 mm. Further, the coil spring may have a third working deflection S3 (m) of approximately 14.0 mm. The spring force F3 (N) for the third working deflection may be approximately 520 N (i.e., S3×RG). The length of the coil spring at the third working deflection S3 may be equal to LO minus S3 or approximately 37.0 mm.

Referring to FIG. 21, one end of the coil spring 228 may be positioned over the spring guide 234 and set against the spring seat 232. A pair of spring clamps (not shown) may be secured to the coil spring 228 and then tightened to compress the coil spring, thereby shortening the length of the coil spring. The distal end 280 of the longitudinal fastener 252 may be arranged through the central bore 240 of the strut insert 224 and advanced into the mating screw threads of the nut 278 in the strut mount 226. The longitudinal fastener 252 may be advanced into the nut 278 until the coils spring 228 is securely seated between the strut insert 224 and the strut mount 226. The spring clamps may be removed, and the initial working length of the coil spring may be adjusted (or set) by advancing or withdrawing the longitudinal fastener 252 from the mating nut 278.

Referring to FIG. 27, the stock body 30 may include a recess 216 in the frame 120 below the receptacle 70 on the proximal side of the lateral passage 122. Referring to FIG. 3, the recess 216 may include a starboard side wall 300 and a port side wall 302. The starboard side wall 300 and the port side wall 302 may each include a borehole 304. The boreholes 304 may extend through the frame 120 to the respective exterior sides of the stock body. The recess 216 may house the proximal end of the strut insert. Referring to FIGS. 10-17, a fastener (e.g., a knuckle pin) 194 may be arranged through the boreholes and the one-eye end 242 of the strut insert 224 to pivotably secure the strut assembly 222 to the frame 120 and form a rear joint 306. See also, FIG. 3 and FIG. 6. The other end of the strut assembly 222 may be secured to the rocker (or lever arm) 54. More particularly, the two-eye end 266 of the strut mount 226 may be pinned to one of the three eyes on the proximal side of the lever arm 54 (i.e., the superior proximal eye 308, the intermediate proximal eye 310, or the inferior proximal eye 312) to pivotably secure the strut assembly 222 to the rocker (or lever arm) 54 and form a front joint 314. See also, FIG. 2 and FIG. 6.

Referring to FIG. 10, the drive link 52 may connect the pin carrier 50 and the rocker (or lever arm) 54 to form a transfer assembly moment arm 316. The transfer assembly moment arm 316 may oscillate about the axis of rotation AOR4 of the inferior joint 206. More particularly, the transfer assembly moment arm may rotate about the axis of rotation AOR4 through an acute angle θ4. For instance, the angle θ4 may be about 20 degrees. In FIGS. 10-17, the angle θ4 measures approximately 18.6 degrees.

Additionally, the transfer assembly moment arm 316 distance (DAMD) may vary as the rocker (or lever arm) 54 rotates under recoil forces transferred to the pin carrier 50 by the latch bolt 44. For instance, the DAMD in the ready state may be DAMD1 (see e.g., FIGS. 12, 14, and 16), whereas the DAMD in the recoil storage state may be DAMD2 (see e.g., FIGS. 13, 15, and 17).

Referring to FIG. 10, the stock positioning latch 42 may include a finger lever 154, a latch bolt 44, a coil spring 318, and a retaining ring 320. Referring to FIGS. 26-27, the latch bolt 44 may include a head 322 that is configured and dimensioned to engage with holes 324 arranged in the bottom of the receiver extension 12. As shown in FIG. 27, the latch bolt 44 may include a shoulder 326 adjacent to the head 322. The shoulder 326 may be configured and dimensioned to form a seat for the coil spring 318. The latch bolt 44 further may include a groove 328 near the distal end. The grove 328 may be a circumferential groove that is configured and dimensioned to receive the retaining ring 320. Generally, the coil spring 318 may be positioned in a counterbore 330 of the pin carrier 50 which may be disposed in the duct 124 that is situated below the receptacle 70. More particularly, the latch bolt 44 may be arranged through the superior elongated slot 140, the coil spring 318, the counterbore 330, the inferior elongated slot 142, and an elongated slot 332 (see also, FIG. 7) in the finger lever 332. The retaining ring 320 may then be inserted into the circumferential groove to secure the assembly.

Generally, as shown in FIGS. 10-17 and 29, a receiver extension (e.g., a buffer tube of an autoloading firearm) 22 may be telescopically received in the receptacle 70 of the stock body 30. The latch bolt 44 may be arranged in the counterbore 330 of the pin carrier 50 and may extend through the superior elongated slot 140 into engagement with one of the holes 324 on the bottom of the receiver extension 12. In a ready state 338 (see e.g., FIG. 10, FIG. 14, FIG. 16, and FIG. 18), the latch bolt 44 may abut or be disposed adjacent to the distal end 334 of the superior elongated slot 140, and the pin carrier 50 may be near the plug 148. By contrast, in a recoil storage state 340 (see e.g., FIG. 11, FIG. 13, FIG. 17, and FIG. 19), the latch bolt 44 may abut or be disposed adjacent to the proximal end 336 of the superior elongated slot 140, and the pin carrier 50 may be distant from the plug 148.

Moreover, the distance measured from the datum line 88 to the axis of rotation $AOR_1$ of the drive link's distal joint 196 may define a first segment 342. The first segment 342 may have a length L1. The distance measured from the datum line 88 to the axis of rotation AOR2 of the drive link's proximal joint 200 may define a second segment 344. The second segment 344 may have a length L2. In the first ready state (or first configuration) 338 (e.g., FIG. 10, FIG. 14, FIG. 16, and FIG. 18), the first distance L1 may be less than the second distance L2. By contrast, in the first recoil storage state (or second configuration) 340 (e.g., FIG. 11, FIG. 13, FIG. 17, and FIG. 19), the first distance L1 may be greater than the second distance L2. Additionally, the latch bolt 44—in the first recoil storage state 340 (e.g, FIG. 11)—may be positioned toward the proximal end 32 of the stock body at a location that is spaced a third distance L3 from the location of the latch bolt 44 in the ready configuration 338 (e.g., FIG. 10).

Figure 12:
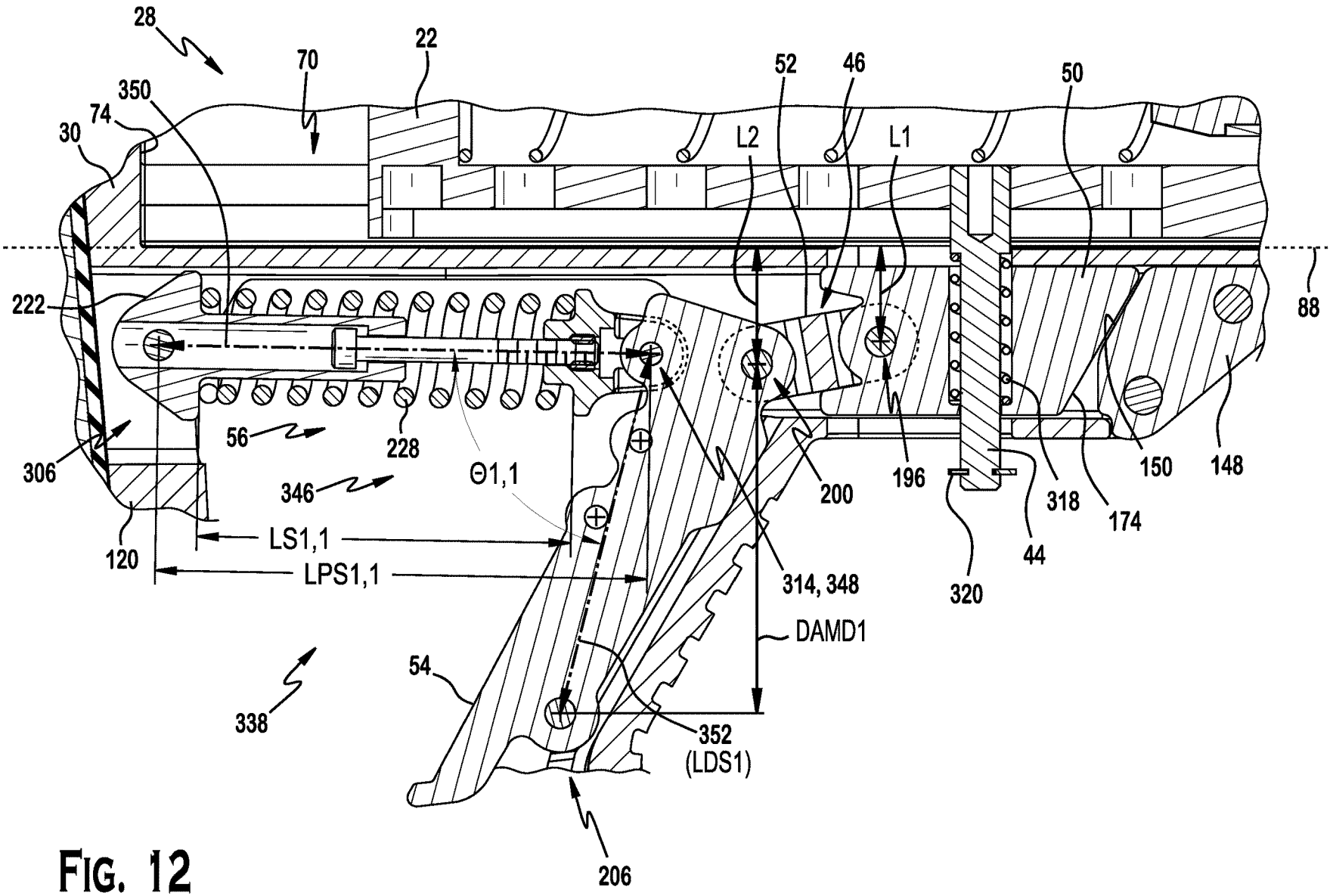
FIG. 12 is a partial sectional view of the stock of FIG. 10.
Figure 13:
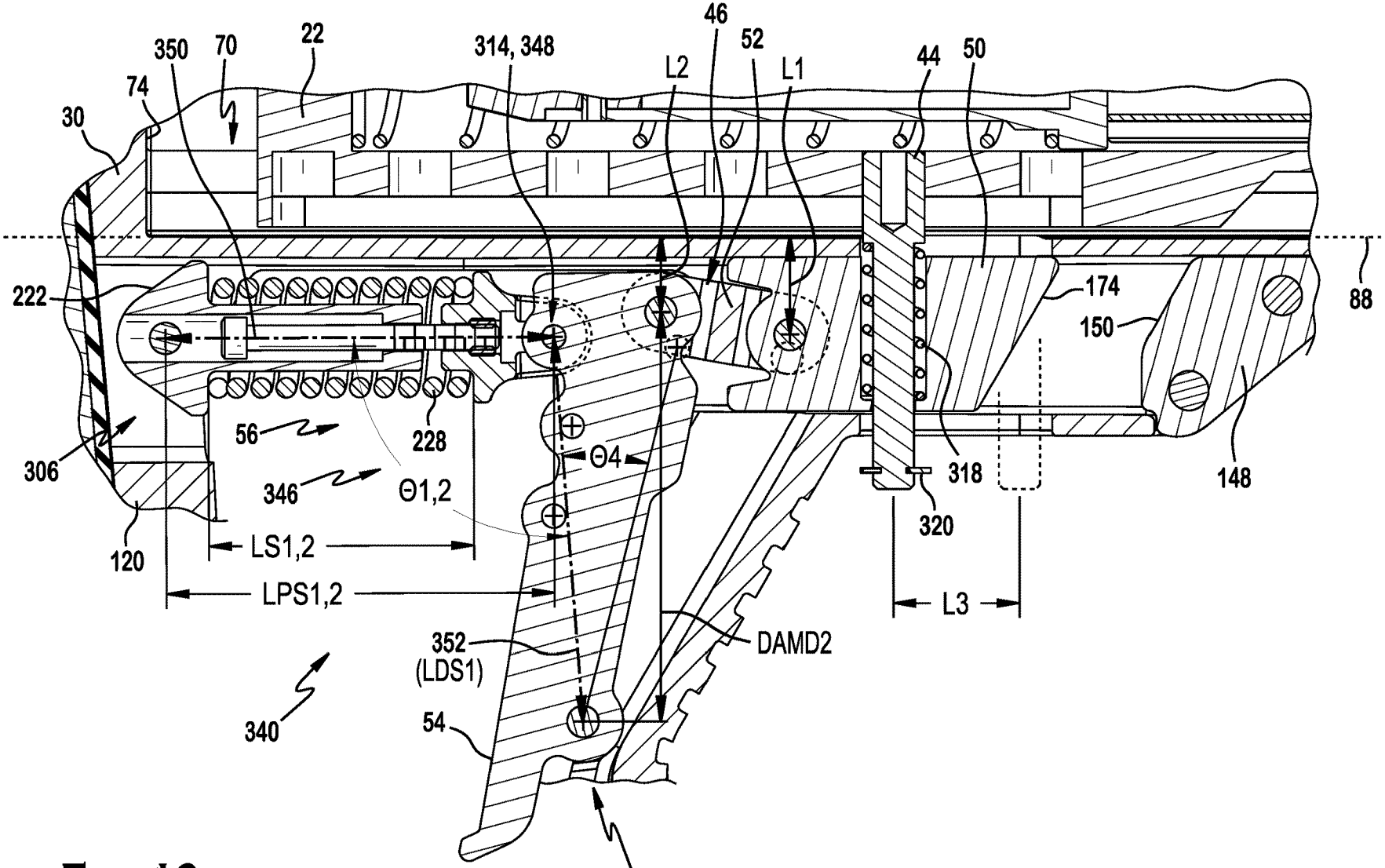
FIG. 13 is a partial sectional view of the stock of FIG. 11.

Referring to FIGS. 12-13, the drive assembly 46 and the recoil force storage apparatus 56 may be arranged in a first operational mode (or Mode 1). Generally, in Mode 1, the strut assembly 222 and the rocker (or lever arm) 54 may form a first linkage 346 which connects the rear joint 306, the superior front joint 348, and the inferior joint 206. More particularly, the first linkage 346 may include a proximal segment 350 that connects the rear joint 306 to the superior front joint 348, as well as a distal segment 352 that connects the superior front joint 348 to the inferior joint 206. The rear joint 306, the superior front joint 348, and the inferior joint 206 may each rotate about an axis of rotation. For example, the rear joint 306 may rotate about axis of rotation AOR3, the superior front joint 348 may rotate about axis of rotation AOR5, and the inferior joint 206 may rotate about axis of rotation AOR4. Moreover, in FIG. 12, the proximal segment 350 may have a length LPS1,1 In FIG. 13, the proximal segment 350 may have a length LPS1,2. In FIG. 12 and FIG. 13, the distal segment 352 may have a length LDS1. Exemplary parameters and values for the drive assembly 46 and recoil force storage apparatus 48 are presented in Table 2 (below).

TABLE 2

Exemplary Drive Assembly and Recoil Force Storage Apparatus Parameters

| Mode | Configuration | FIG. | L1 (mm) | L2 (mm) | DAMD (mm) | LS (mm) | LPS (mm) | LDS (mm) | θ4 (deg.) | Θ (deg.) |
|---|---|---|---|---|---|---|---|---|---|---|
| 1 | 1 | 12 | 12.5 | 15.5 | 45.8 | 49.1 | 64.6 | 48.6 | 0 | 76.8 |
| | 2 | 13 | 12.5 | 9.7 | 51.6 | 33.5 | 49.0 | 48.6 | 18.6 | 94.2 |
| 2 | 3 | 14 | 12.5 | 15.5 | 45.8 | 48.9 | 64.4 | 37.3 | 0 | 84.8 |
| | 4 | 15 | 12.5 | 9.7 | 51.6 | 37.0 | 52.5 | 37.3 | 18.6 | 104.3 |
| 3 | 5 | 16 | 12.5 | 15.5 | 45.8 | 47.5 | 61.7 | 26.2 | 0 | 101.1 |
| | 6 | 17 | 12.5 | 9.7 | 51.6 | 38.3 | 53.8 | 26.2 | 18.6 | 122.8 |

Figure 11:
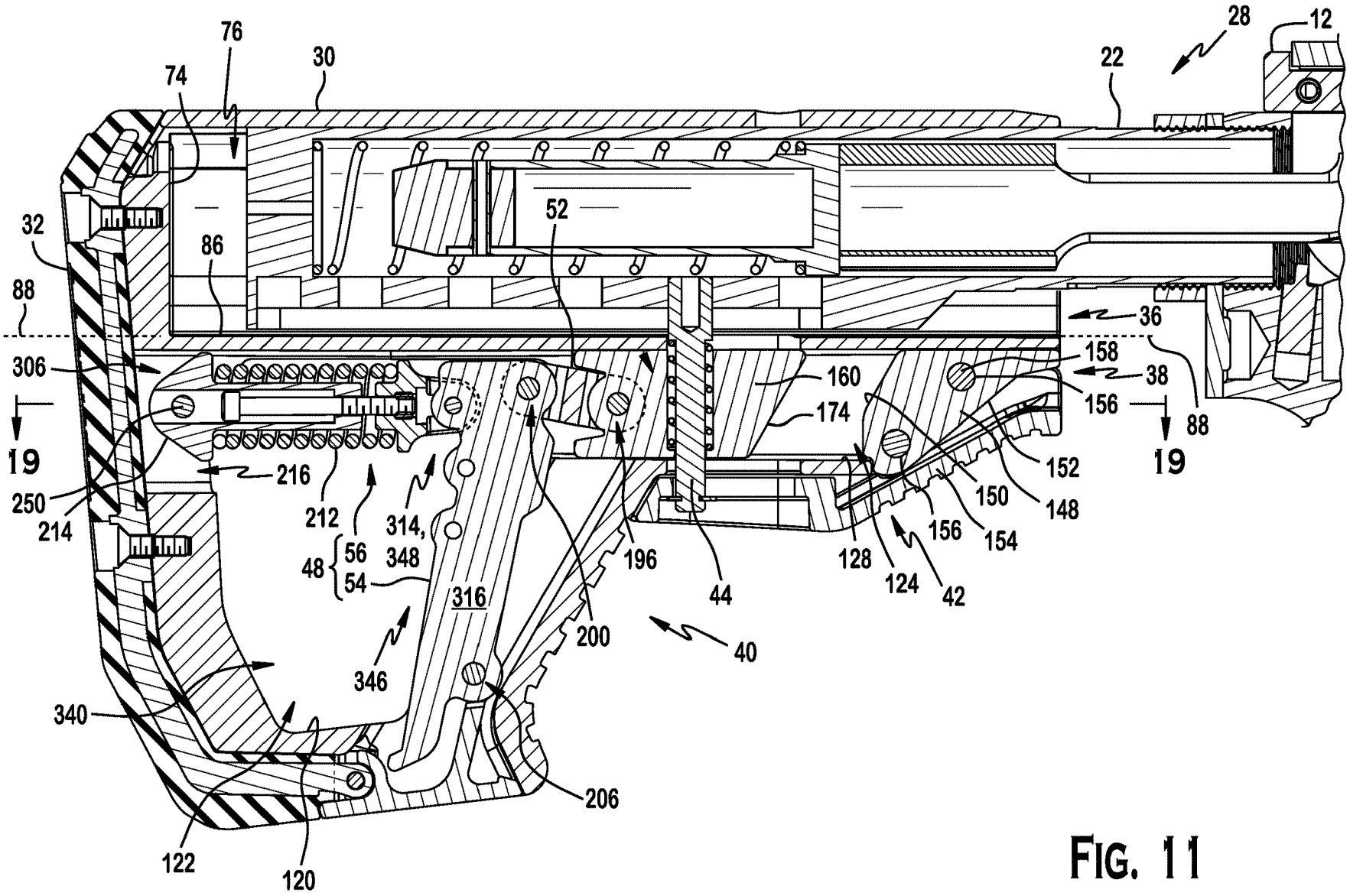
FIG. 11 is cross-sectional view of the stock of FIG. 5 along line 10-10, the stock being deployed on a receiver extension of a firearm, and the recoil reduction system being arranged in a second configuration.

The first linkage 346 may oscillate between a first ready state (or first configuration) 338 as shown in FIGS. 10 and 12, and a first recoil force storage state (or second configuration) 340 as shown in FIGS. 11 and 13. Referring to FIG. 12, the proximal segment 350 and the distal segment 352 may define an interior angle Θ1,1. The interior angle Θ1,1 may be an acute angle. For instance, the interior angle Θ1,1 may be about 75 degrees. More particularly, the interior angle Θ1,1 may measure approximately 76.8 degrees. Referring to FIG. 13, the interior angle Θ1,2 in the recoil force storage state 340 may be an obtuse angle. For instance, the interior angle Θ1,2 may be about 95 degrees. More particularly, the interior angle Θ1,2 may measure approximately 94.2 degrees.

Referring to FIG. 12, the coil spring 228 of the strut assembly 222 may be compressed to a ready working length LS1,1. The coil spring 228 may bias the drive assembly 46 (44, 50, 52) and the recoil force storage apparatus 48 (54, 56) into a first ready state (or first configuration) 338. The spring force may be sufficient to secure the drive assembly 46 and the recoil force storage apparatus 48 in the first configuration 338 against forces or vibrations generated from carrying, manipulating, or transporting the stock and host firearm. For instance, the first working length LS1,1 may be approximately 50 mm. More particularly, the first working length LS1,1 may measure approximately 49.1 mm.

Referring to FIG. 13, recoil force(s) RF applied to the drive assembly 46 and the recoil force storage apparatus 56 may compress the coil spring 228 to a reduced working length LS1,2, and thus position the drive assembly 46 and the recoil force storage apparatus 56 into a first recoil force storage state (or second configuration) 340. For instance, the reduced working length LS1,2 may be approximately 32 mm. More particularly, the reduced working length LS1,2 may measure approximately 33.5 mm.

Figure 14:
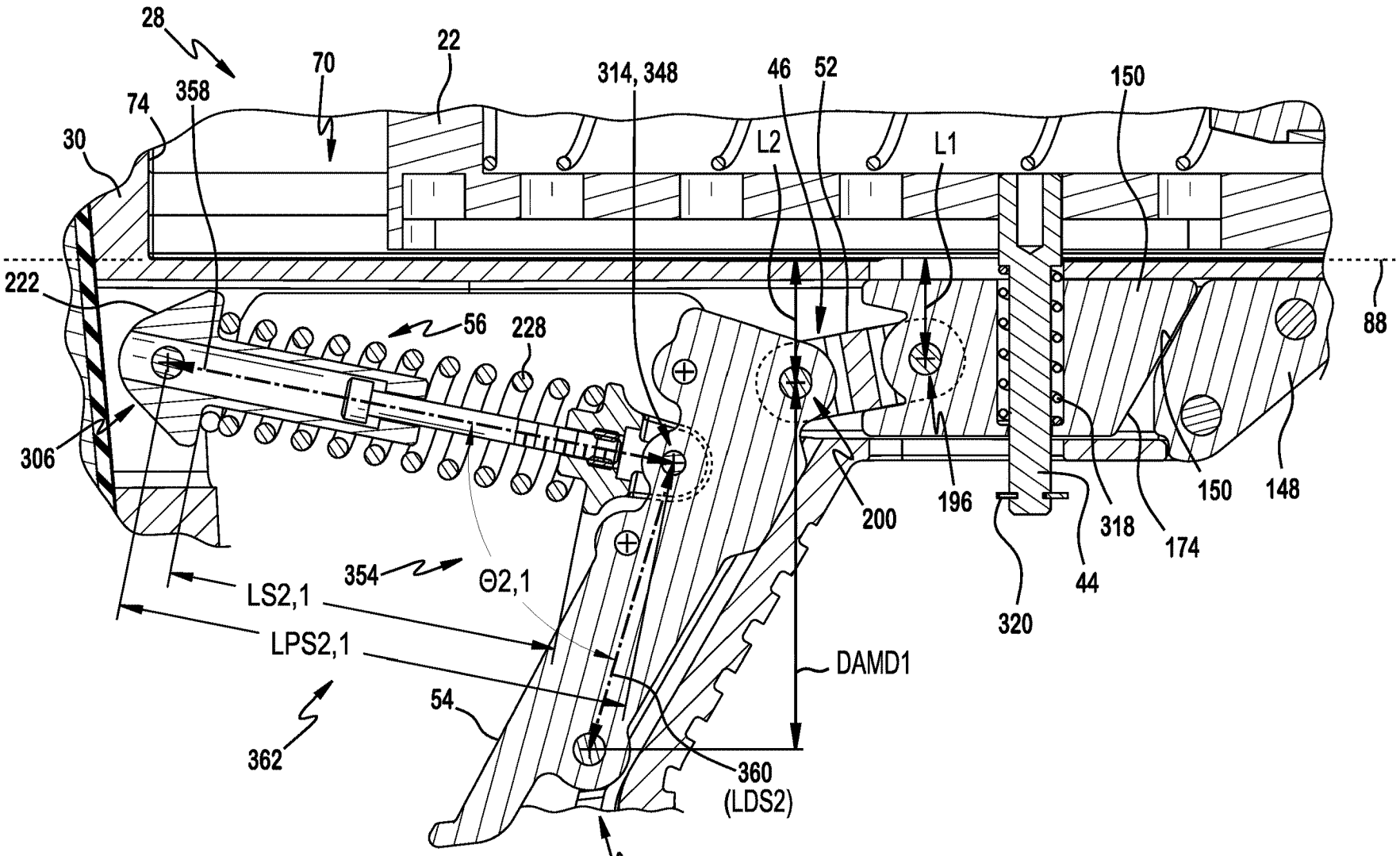
FIG. 14 is a partial sectional view of the stock of FIG. 5 along line 10-10, the stock being deployed on a receiver extension of a firearm, and the recoil reduction system being arranged in a third configuration.
Figure 15:
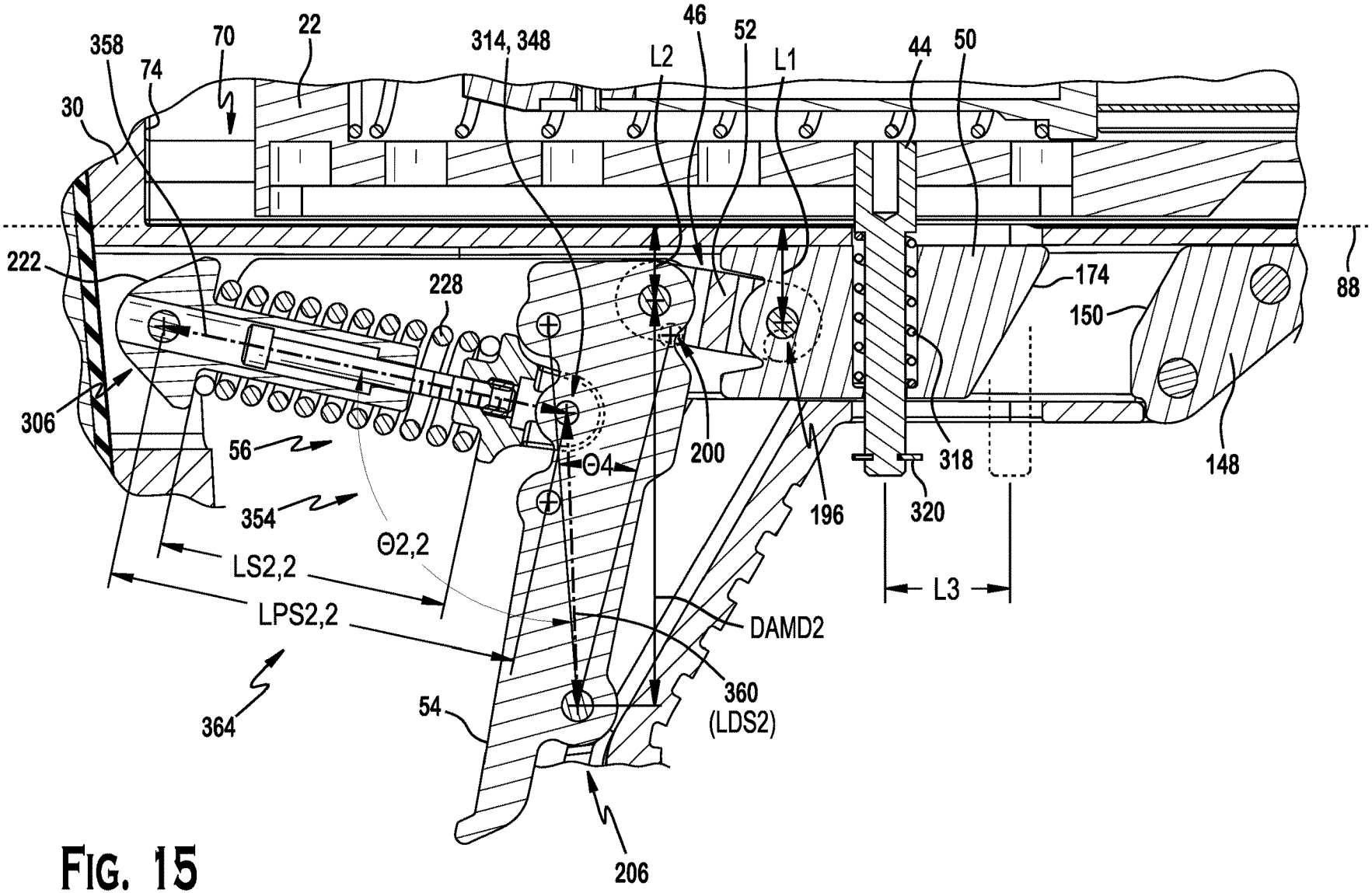
FIG. 15 is a partial sectional view of the stock of FIG. 5 along line 10-10, the stock being deployed on a receiver extension of a firearm, and the recoil reduction system being arranged in a fourth configuration.

Referring to FIG. 14 and FIG. 15, the drive assembly 46 and the recoil force storage apparatus 48 may be arranged in a second operational mode (or Mode 2). Generally, in Mode 2, the strut assembly 222 and the rocker (or lever arm) 54 may form a second linkage 354 which connects the rear joint 306, the intermediate front joint 356, and the inferior joint 206. More particularly, the second linkage 354 may include a second proximal segment 358 that connects the rear joint 306 to the intermediate front joint 356, as well as a second distal segment 360 that connects the intermediate front joint 356 to the inferior joint 206. The rear joint 306, the intermediate front joint 356, and the inferior joint 206 may each rotate about an axis of rotation. For example, the rear joint 206 may rotate about axis of rotation AOR3, the intermediate front joint 356 may rotate about axis of rotation AOR6, and the inferior joint 206 may rotate about axis of rotation AOR4. In FIG. 14, the second proximal segment 358 may have a length LPS2,1. In FIG. 15, the second proximal segment 358 may have length LPS2,2. In FIGS. 14 and 15, the second distal segment 360 may have a length LDS2.

The second linkage 354 may oscillate between a second ready state (or third configuration) 362 as shown in FIG. 14, and a second recoil force storage state (or fourth configuration) 364 as shown in FIG. 15. Referring to FIG. 14, the second proximal segment 358 and the second distal segment 360 may define an interior angle Θ2,1. The interior angle Θ2,1 may be an acute angle. For instance, the interior angle Θ2,1 may be about 80 degrees. More particularly, the interior angle Θ2 may measure approximately 84.8 degrees. By contrast, in the fourth configuration (FIG. 15), the interior angle Θ2,2 may be an obtuse angle. For instance, the interior angle Θ2,2 may be about 100 degrees. More particularly, the interior angle Θ2 may measure approximately 104.3 degrees.

Referring to FIG. 14, the coil spring 228 of the strut assembly 222 may be compressed to a ready working length LS2,1. The coil spring 228 may bias the drive assembly 46 (44, 50, 52) and the recoil force storage apparatus 48 (54, 56) into the ready state (or third configuration) 338. The spring force may be sufficient to secure the drive assembly 46 and the recoil force storage apparatus 48 in the third configuration 338 against forces or vibrations generated from carrying, manipulating, or transporting the stock and host firearm. For instance, the ready working length LS2,1 may be approximately 50 mm. More particularly, the ready working length LS2,1 may measure approximately 48.9 mm.

Referring to FIG. 15, recoil force(s) RF applied to the drive assembly 46 and the recoil force storage apparatus 56 may compress the coil spring 228 to a reduced working length LS2,2, and thus position the drive assembly 46 and the recoil force storage apparatus 56 into a recoil force storage state (or fourth configuration) 340. For instance, the reduced working length LS2,2 may be approximately 36 mm. More particularly, the reduced working length LS1,2 may measure approximately 37.0 mm.

Figure 16:
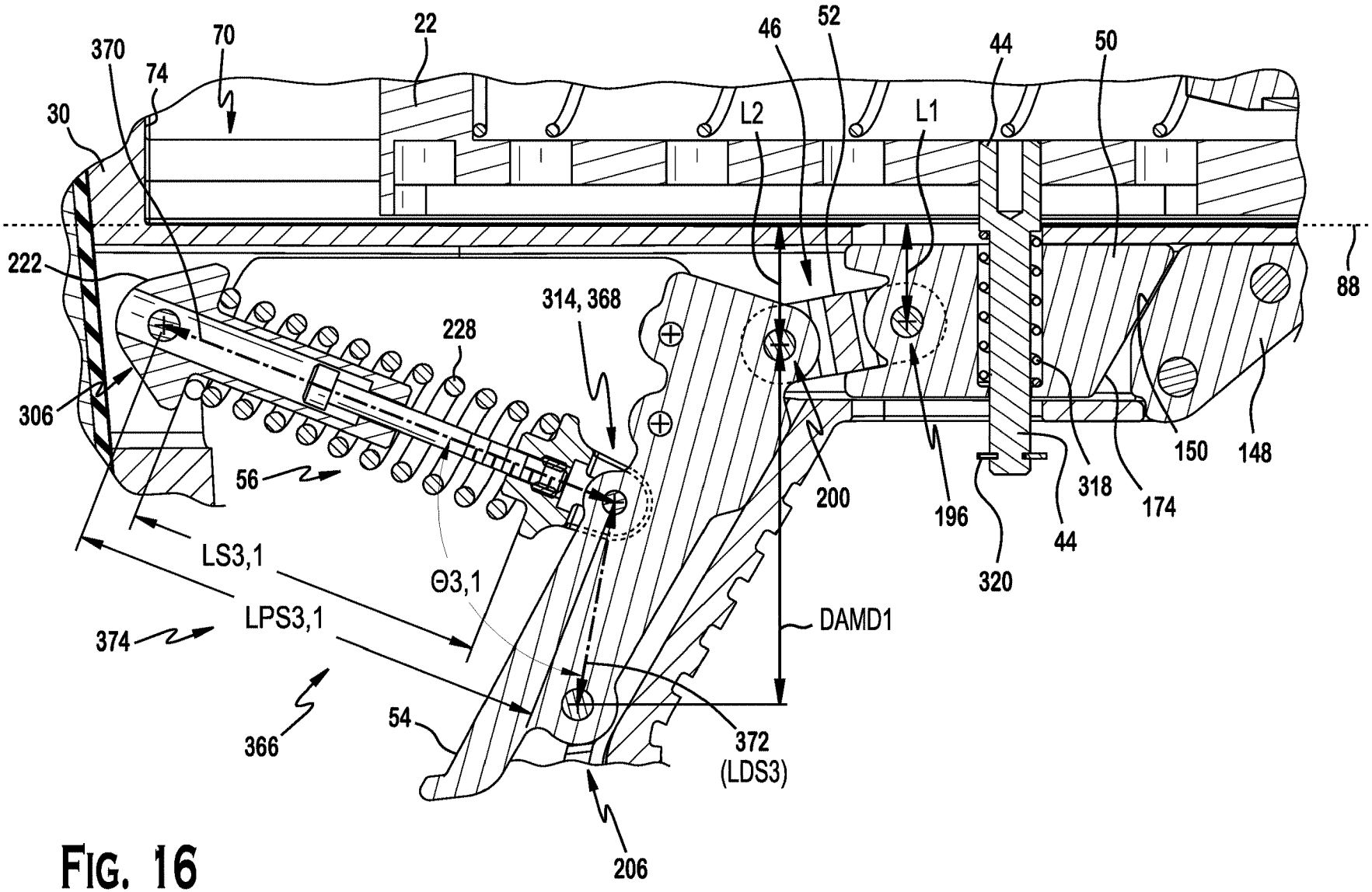
FIG. 16 is a partial sectional view of the stock of FIG. 5 along line 10-10, the stock being deployed on a receiver extension of a firearm, and the recoil reduction system being arranged in a fifth configuration.
Figure 17:
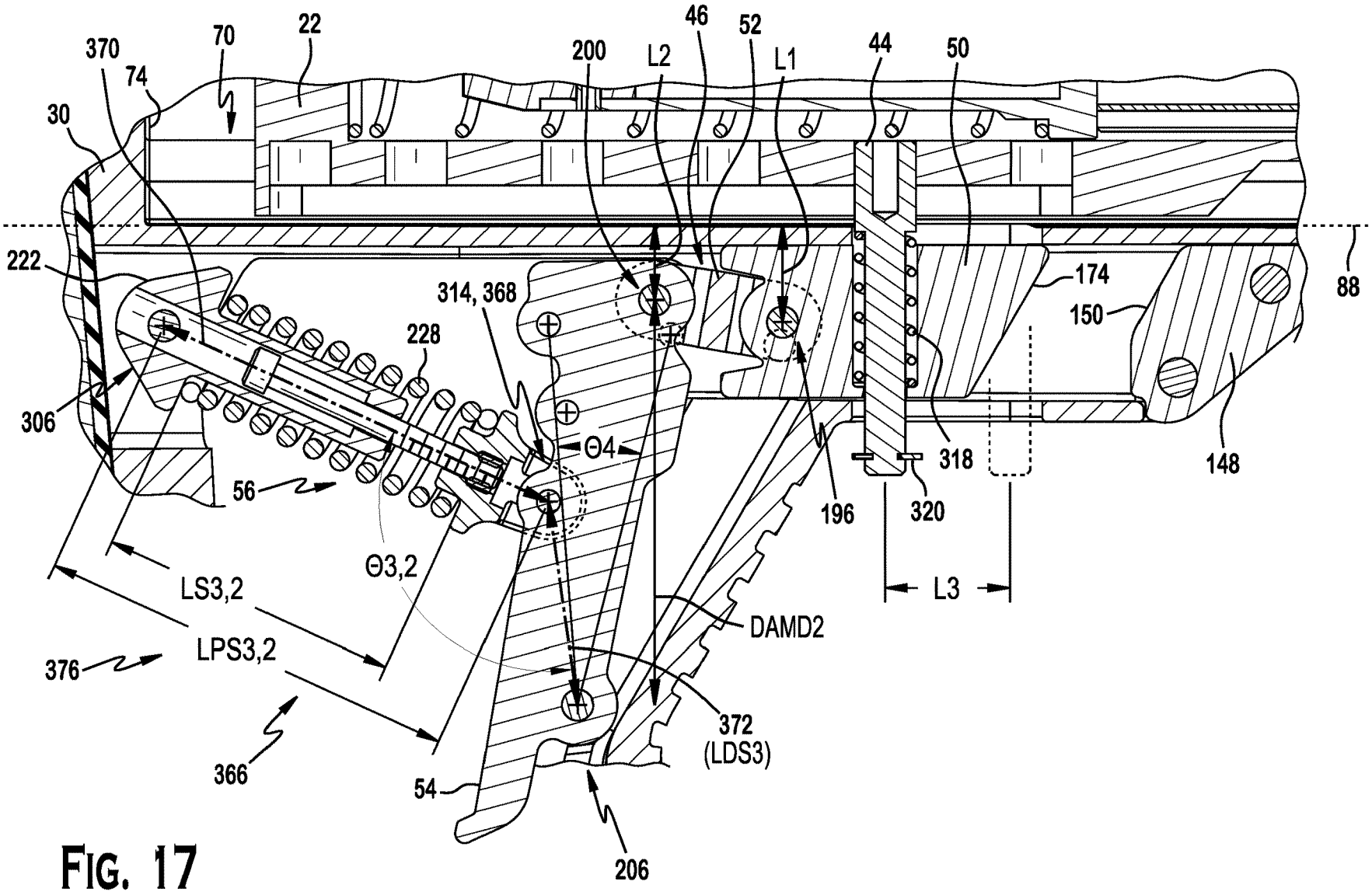
FIG. 17 is a partial sectional view of the stock of FIG. 5 along line 10-10, the stock being deployed on a receiver extension of a firearm, and the recoil reduction system being arranged in a sixth configuration.
Figure 18:
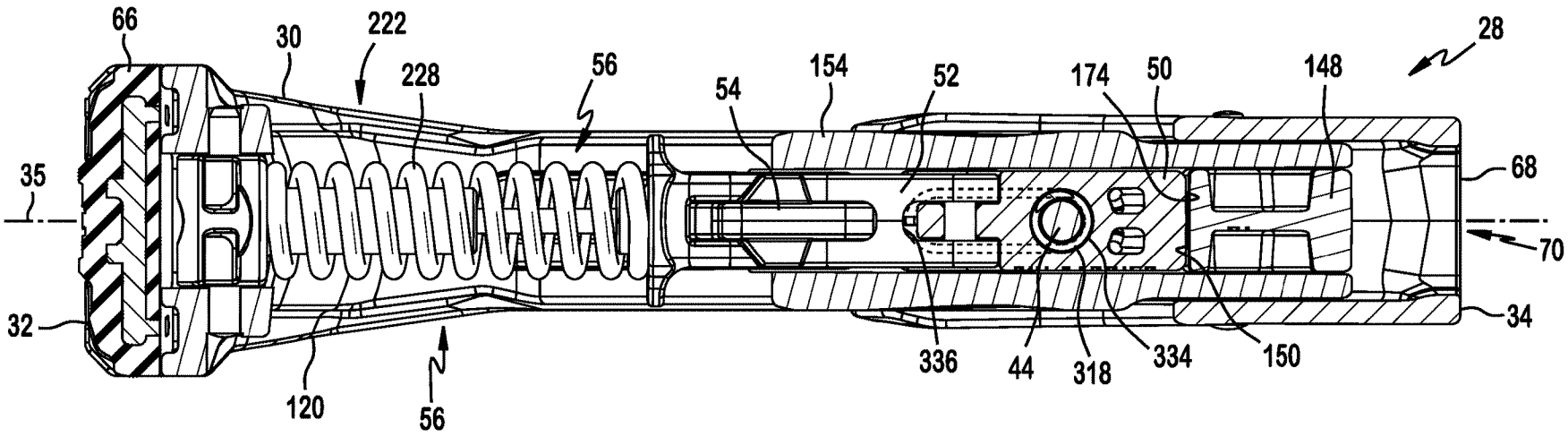
FIG. 18 is a cross-sectional view of the stock of FIG. 6 along line 18-18, the stock being arranged in the first configuration.
Figure 19:
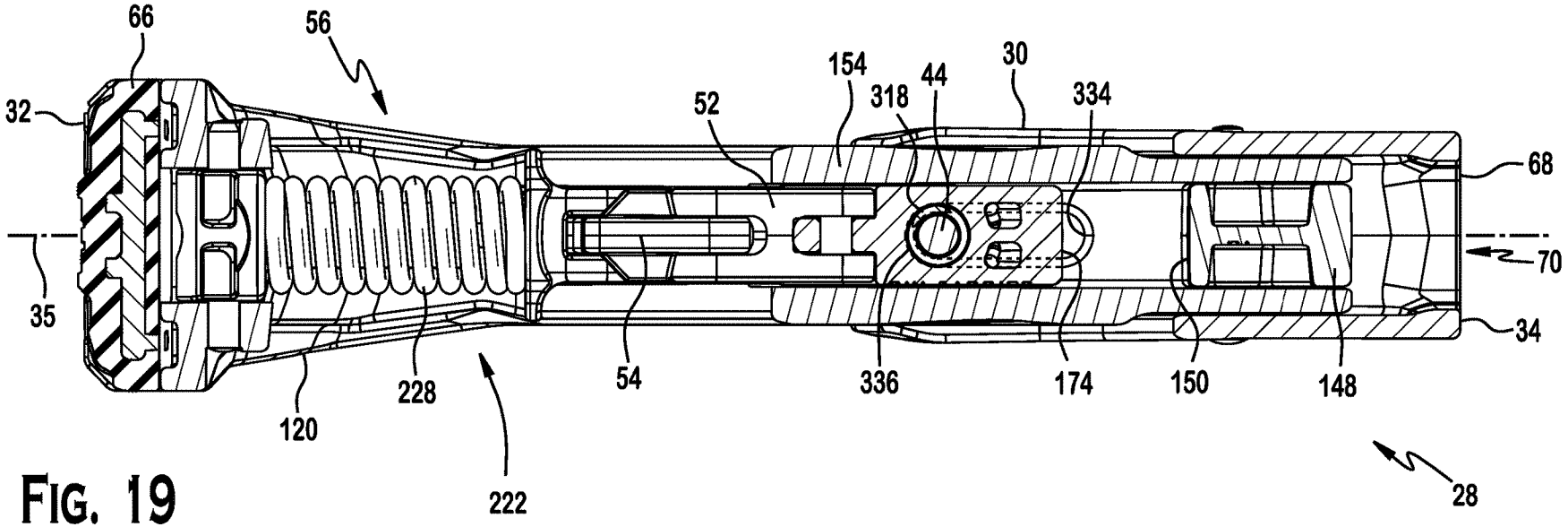
FIG. 19 is a cross-sectional view of the stock of FIG. 6 along line 18-18, the stock being arranged in the second configuration.

Referring to FIG. 16 and FIG. 17, the drive assembly 46 and the recoil force storage apparatus 48 may be arranged in a third operational mode (or Mode 3). In Mode 3, the strut assembly 222 and the rocker (or lever arm) 54 may form a third linkage 366 which connects the rear joint 306, the inferior front joint 368, and the inferior joint 206. More particularly, the third linkage 366 may include a third proximal segment 370 that connects the rear joint 306 to the inferior front joint 368, as well as a third distal segment 372 that connects the inferior front joint 368 to the inferior joint 206. The rear joint 306, the inferior front joint 368, and the inferior joint 206 may each rotate about an axis of rotation. For example, the rear joint 306 may rotate about axis of rotation AOR3, the inferior front joint 368 may rotate about axis of rotation AOR7, and the inferior joint 206 may rotate about axis of rotation AOR4. In FIG. 16, the third proximal segment 370 may have a length LPS3,1. In FIG. 16, the third proximal segment 370 may have a length LPS3,2. In FIGS. 16 and 17, the third distal segment 372 may have a length LDS3.

The third linkage 366 may oscillate between a third ready state (or fifth configuration) 374 as shown in FIG. 16, and a third recoil force storage state (or sixth configuration) 376 as shown in FIG. 17. Referring to FIG. 16, the third proximal segment 370 and the third distal segment 372 may define an interior angle Θ3,1. The interior angle Θ3,1 may be an obtuse angle. For instance, the interior angle Θ3,1 may be about 100 degrees. More particularly, the interior angle Θ3,1 may measure approximately 101.1 degrees. Referring to FIG. 17, in the third recoil force storage state the interior angle Θ3,2 may be an obtuse angle. For instance, the interior angle Θ3,2 may be about 120 degrees. More particularly, the interior angle Θ3,2 may measure approximately 122.8 degrees.

Referring to FIG. 16, the coil spring 292 may be compressed to a ready working length LS3,1. The coil spring 228 may bias the drive assembly 46 and the recoil force storage apparatus 48 into the fifth configuration 374. Further, the spring force may be sufficient to secure the drive assembly 46 and the recoil abatement apparatus 48 in the fifth configuration 374 against forces or vibrations generated from carrying, manipulating, or transporting the stock and host firearm. For instance, the ready working length LS3,1 may be about 48 mm. More particularly, the ready working length LS3,1 may measure approximately 47.5 mm.

Referring to FIG. 17, recoil force(s) RF applied to the drive assembly 46 and the recoil force storage apparatus 56 may compress the coil spring 228 to a reduced working length LS3,2, and thus position the drive assembly 46 and the recoil force storage apparatus 56 into a third recoil force storage state (or sixth configuration) 340. For instance, the reduced working length LS3,2 may be approximately 38 mm. More particularly, the reduced working length LS3,2 may measure approximately 38.3 mm.

Referring to FIGS. 11-17, the drive assembly 46 and the recoil force storage apparatus 56 may be restricted in their respective movements. For example, translation of the latch bolt 44 may be restricted to the length of the superior elongated slot 140 and/or the inferior elongated slot 142. As shown in FIG. 12, the distal end of the superior elongated slot 140 blocks forward movement of the latch bolt 44. As shown in FIG. 13, the proximal end of the superior elongated slot 140 blocks rearward movement of the latch bolt 44. Thus, the latch bolt 44 may translate between the proximal end of the superior elongated slot 140 and the distal end of the superior elongated slot 140. Accordingly, the travel of the latch bolt 44, may not exceed length L3. In the exemplary embodiment, length L3 may be approximately 15.9 mm. Moreover, as the latch bolt 44 drives the pin carrier 50, the travel of the pin carrier may be limited to the travel of the latch bolt. Similarly, rotation of the rocker about pivot 206 may not exceed angle θ4. In the exemplary embodiment, the angle θ4 may be an acute angle. More particularly, the angle θ4 may be approximately 18.5 degrees. Additionally, the length of the travel of the latch bolt 44 may be less than the solid deflection SB of the coil spring. For instance, L3 may be approximately 15.9 mm and SB may be approximately 18.9 mm. Thus, the drive assembly 46 may be prevented from fully collapsing the spring or over rotating the rocker arm, thereby protecting the drive assembly 46 and the recoil force storage apparatus 56 from damage.

Moreover, the operation of the drive assembly 46 and recoil force storage apparatus 48 may involve the use of a variably selectable degrees of mechanical advantage to achieve differing levels of recoil reduction. More particularly, the greater the mechanical advantage of the rocker typically results in greater recoil reduction during use. The mechanical advantage of the rocker may be calculated by dividing the force transferred to the spring by the rocker FS by the force applied to the rocker by the drive assembly FA. Moreover, the rocker may be selectively connected to the strut assembly to adjust the length of the moment arm which applies force to the strut assembly that in turn deflects the coil spring. Generally, the shorter the moment arm, the greater level of force that is applied to the strut assembly for a given force applied by the drive assembly. Thus, the mechanical advantage of the rocker may be increased by shortening the length of the moment arm that applies force to the strut assembly. Similarly, the mechanical advantage of the rocker may be decreased by increasing the length of the moment arm that applies force to the strut assembly.

For instance, the strut assembly may be connected to the rocker in one of three configurations (i.e., Mode 1, Mode 2, Mode 3). In Mode 1, the moment arm that applies force to the strut assembly (LDS) may possess a length of approximately 48.6 mm. By contrast, the moment arm of the drive assembly (DADA) may possess an average length of approximately (45.8+51.6)/2 mm or 48.7 mm. Accordingly, the mechanical advantage of the rocker in Mode 1 may be about (48.7/48.6) or 1.0. In Mode 2, the moment arm that applies force to the strut assembly (LDS) may possess a length of approximately 37.3 mm. The moment arm of the drive assembly (DADA) may possess an average length of approximately 48.7 mm. Thus, the mechanical advantage of the rocker in Mode 2 may be about (48.7/37.3) or 1.3. In Mode 3, the moment arm that applies force to the strut assembly (LDS) may possess a length of approximately 26.2 mm, and the moment arm of the drive assembly (DADA) may possess an average length of approximately 48.7 mm. Therefore, the mechanical advantage of the rocker in Mode 3 may be about (48.7/26.2) or 1.9.

In view of the above, Mode 3 may provide a greater level of recoil reduction than Mode 2, and Mode 2 may provide a greater level of recoil reduction than Mode 1. Further, the recoil impulse applied to the shoulder of the operator in Mode 2 and Mode 3 may be approximately 77% (1.0/1.3) and approximately 53% (1.0/1.9) of the recoil impulse applied to the shoulder of the operator by Mode 1, respectively. Moreover, other embodiments of the drive assembly 46 and the recoil force storage apparatus 48 may include additional eyes on the spring side of the rocker to provide additional locations for the front joint, and thus provide additional degrees of mechanical advantage for the rocker.

In use, the stock may be secured to the receiver extension of a firearm. More particularly, the receiver extension may be telescopically received in the receptacle 70 of the stock body 30. Moreover, the stock positioning latch 42 may selectively couple the latch bolt 44 to the receiver extension 22. The latch bolt 44 also may connect the receiver extension 22 to the recoil reduction system 40. For instance, the latch bolt 44 may be positioned in the pin carrier 50 of the drive assembly 46. The drive assembly 46 further may include the drive link 52 that is pinned to the rocker 54. Thus, recoil generated by the firearm may be transferred from the receiver extension to the pin carrier via the latch bolt. The recoil transferred to the pin carrier may push the rocker arm against the strut assembly. The coil spring of the strut assembly may deflect under the impulse applied by the rocker arm. The strut assembly may then push the rocker back to its original position as the coil spring elongates to its initial working length after the impulse has passed. Prior to use, the strut assembly may be selectively connected to one of the three eyes on the rocker. Each of the three eyes may provide the recoil reduction system with a different operable configuration (or Mode). Each Mode may possess a different capability for recoil to the operator's shoulder. For instance, Mode 1 may provide less recoil reduction than Mode 2, and Mode 2 may provide less recoil reduction than Mode 3.

While it has been illustrated and described what at present are considered to be preferred embodiments of the invention, it will be understood by those skilled in the art that various changes and modifications may be made, and equivalents may be substituted for elements thereof without departing from the true scope of the invention. For example, the profile of the butt stock body and the components of the first and second variable adjustment regulation assemblies may be adapted for use with a particular geometry, firearm, or tactical requirement. Therefore, it is intended that the invention not be limited to the particular embodiments disclosed herein. Rather, the accompanying scope of protection and their equivalents are intended to cover such forms or modifications as would fall within the scope and spirit of the following claims.

What is claimed is:

1. A stock for a small arms weapon comprising:

a stock body including a first longitudinal axis, the stock body comprising a proximal end, a distal end spaced from the proximal end along the first longitudinal axis, a receptacle open to the distal end for receiving a receiver extension, a duct spaced from the receptacle, the duct being aligned with the longitudinal axis, a slot extending from the duct to the receptacle, an aft fastener receiving hole adjacent to the proximal end, and an inferior fastener receiving hole spaced from the aft fastener receiving hole;

a block disposed in the duct, the block comprising an upper surface, a lower surface, a countersunk bore extending from the upper surface to the lower surface, and a first one-eye end adjacent to the upper surface and the lower surface;

a latch bolt received in the countersunk bore, the latch bolt being arranged through the slot and extending into the receptacle;

a link which comprises a proximal two-eye end and a distal two-eye end, the distal two-eye end being pivotably connected to the first one-eye end by a first fastener to form a distal joint;

a rocker which comprises a proximal side comprising a plurality of eyes, and a distal side which comprises a superior eye and an inferior eye, the superior eye being pivotably connected to the proximal two-eye end by a second fastener to form a proximal joint, and the inferior eye being pivotably connected to the inferior fastener receiving hole by a third fastener to form an inferior joint;

a strut insert comprising an aft one-eye end, a spring guide adjacent to the aft one-eye end, and a first bore extending through the spring guide, the aft one-eye end being pivotably connected to the aft fastener receiving hole by a fourth fastener to form a rear joint;

a strut mount comprising a fore two-eye end, the fore two-eye end being pivotably connected to one of the plurality of eyes by a fifth fastener to form a front joint;

a longitudinal fastener arranged in the first bore and secured to the strut mount; and a spring between the aft one-eye end and the fore two-eye end.

2. The stock of claim 1, wherein the strut mount further comprises:

a fore spring seat adjacent to the fore two-eye end, the fore spring seat comprising a second countersunk bore, and a nut which comprises a first screw thread, the nut being disposed in the second countersunk bore, wherein the longitudinal fastener further comprises a second screw thread, the second screw thread being configured and dimensioned to mate with the first screw thread to connect the longitudinal fastener to the strut mount.

3. The stock of claim 1, wherein the spring is arranged about the spring guide.

4. The stock of claim 1, wherein the spring has a non-circular cross section.

5. The stock of claim 4, wherein the non-circular cross section is rectangular and comprises a width and a height, and the width of the rectangular cross section measures about 3.1 mm and the height of the rectangular cross section measures about 2.5 mm.

6. The stock of claim 1, wherein the spring possesses a spring constant ranging from 33 N/mm to 41 N/mm.

7. The stock of claim 6, wherein the spring constant is approximately 37.1 N/mm.

8. The stock of claim 7, wherein the spring has a free length of about 51 mm and a solid height of about 32 mm.

9. The stock of claim 1, wherein the spring has a ready working length of approximately 50 mm and a reduced working length of approximately 32 mm.

10. The stock of claim 1, wherein the spring has a ready working length of approximately 50 mm and a reduced working length of approximately 36.

11. The stock of claim 1, wherein the spring has a ready working length of approximately 48 mm and a reduced working length of approximately 38.

12. The stock of claim 1, wherein the plurality of eyes on the proximal side of the rocker comprises a superior proximal eye, an intermediate proximal eye, and an inferior proximal eye.

13. The stock of claim 12, wherein the strut mount is selectively arranged in one of a plurality of operational modes comprising a first operational mode which comprises a first ready state in which the fore two-eye end of the strut mount is connected to the superior proximal eye;

a second operational mode which comprises a second ready state in which the fore two-eye end of the strut mount is connected to the intermediate proximal eye; and a third operational mode which comprises a third ready state in which the fore two-eye end of the strut mount is connected to the inferior proximal eye.

14. The stock of claim 13, wherein the first operational mode provides a first level of recoil reduction, the second operational mode provides a second level of recoil reduction, and the third operational mode provides a third level of recoil reduction.

15. The stock of claim 14, wherein the third level of recoil reduction is greater than the second level of recoil reduction, and the second level of recoil reduction is greater than the first level of recoil reduction.

16. The stock of claim 1, further comprising a second spring disposed in the countersunk bore, the latch bolt being arranged through the second spring.

17. A method of reducing recoil from a firearm having a receiver extension comprising:

providing a stock of claim 1;

securing the receiver extension in the receptacle;

connecting the strut mount to one of the plurality of eyes;

generating recoil by discharging the firearm;

transferring recoil from the receiver extension to the latch pin;

moving the latch pin, block, link, and rocker to compress the spring; and expanding the spring to bias the rocker, link, block, and latch pin toward the distal end of the stock body.

* * * * *